US009857759B1

(12) United States Patent
Boyatt et al.

(10) Patent No.: US 9,857,759 B1
(45) Date of Patent: Jan. 2, 2018

(54) POSITIVE LOCKING MECHANISM FOR A REMOVABLE FUSER

(71) Applicant: LEXMARK INTERNATIONAL, INC., Lexington, KY (US)

(72) Inventors: Richard Gordon Boyatt, Lexington, KY (US); Gregory Daniel Creteau, Winchester, KY (US); Christopher Hayden Noffsinger, Lexington, KY (US); Donald Eugene Proffitt, Richmond, KY (US); Edward Alan Rush, Richmond, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 15/334,556

(22) Filed: Oct. 26, 2016

(51) Int. Cl.
*G03G 15/20* (2006.01)
*G03G 21/16* (2006.01)

(52) U.S. Cl.
CPC ..... *G03G 21/1647* (2013.01); *G03G 21/1685* (2013.01)

(58) Field of Classification Search
CPC ..... G03G 21/1647; G03G 21/1685
USPC ..... 399/122
See application file for complete search history.

(56) References Cited

U.S. PATENT DOCUMENTS 6,697,589 B1 * 2/2004 Dunning et al. ... G03G 21/1647 399/122
9,158,270 B2 * 10/2015 Nan No ..... G03G 21/1647

* cited by examiner

*Primary Examiner* — William J Royer

(57) ABSTRACT

An imaging device includes a frame plate having an opening and first and second camming profiles about the opening. A removable fuser assembly includes a housing having front and back plates, a mounting shaft extending from the front plate to the back plate of the housing, a pin member on a first end of the mounting shaft having a pair of segments engaging with the first and second camming profiles on the frame plate, and a handle on a second end of the mounting shaft pivotable at a predetermined angle and moving the mounting shaft therewith. Pivoting the handle in a first direction causes the segments to travel along the camming profiles, locking the fuser assembly onto the imaging device. Pivoting the handle in a second direction causes the segments to align with the opening and the fuser assembly to be unlocked with the imaging device allowing removal thereof.

20 Claims, 24 Drawing Sheets

POSITIVE LOCKING MECHANISM FOR A REMOVABLE FUSER

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Disclosure

The present disclosure relates generally to a locking system for a removable fuser assembly of an imaging device.

2. Description of the Related Art

In an electrophotographic imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter a toner image is transferred to a media intended to receive a final permanent image. The toner image is fixed to the media by the application of heat and pressure in a fuser assembly. A fuser assembly may include a heated roll and a backup roll forming a fuser nip through which the media passes. A fuser assembly may also include a fuser belt and an opposing backup member, such as a backup roll. Because components of fuser assemblies wear over time, many fuser assemblies are replaceable.

Prior approaches for securing a replaceable fuser assembly in an imaging device typically include the use of fasteners, such as threaded thumbscrews. In using thumbscrews to properly seat a fuser assembly in the imaging device, users or service technicians are required to turn the thumbscrews a number of revolutions in a first direction. This action secures the fuser assembly onto its mounting datums. In order to unlock the fuser assembly from being latched onto mounting datums within the imaging device, the user is required to rotate the thumbscrews the same amount in a second direction opposite the first. Grips or handles are typically provided on the removable fuser assembly to facilitate the removal of the fuser assembly from the imaging device once the fuser assembly is unlocked.

While thumbscrews may provide some tactile indication as to whether or not the fuser assembly is locked, it is left to the user or service technician to decide whether the fuser assembly is properly positioned and fully locked within the imaging device, thus rendering an amount of guesswork in the process of installing the fuser assembly. Other fuser assembly locking designs also depend on the user to manually provide a locking or clamping force. To this end, the locking engagement between the fuser assembly and the imaging device may be inconsistent each time the fuser assembly is installed. Positioning a fuser assembly at an indeterminate position relative to its alignment datums within the imaging device may cause media sheet skews, jams and defects, and may accelerate fuser assembly life, for example, premature drive gear wear.

SUMMARY

Example embodiments of the present disclosure overcome shortcomings of existing fuser assembly locking mechanisms. According to an example embodiment, an imaging device includes a frame plate extending between opposing side panels thereof and a fuser assembly disposed adjacent the frame plate when installing the fuser assembly within the imaging device. The frame plate includes an opening and first and second camming profiles at least partly disposed around the opening.

In the example embodiment, the fuser assembly includes a housing, a pair of mounting shafts extending from the front to the back of the housing, a pin member disposed at a first end of each mounting shaft having a pair of radially extending segments, and a handle on a second end of each mounting shaft for rotating the mounting shaft in first and second directions. Rotational movement of the mounting shaft causes the pin member to travel along the first and second camming profiles of the imaging device frame plate. The fuser assembly assumes an operable position thereof within the imaging device and is locked to the frame plate of the imaging device following completion of the pin segments travelling along the first and second camming profiles in the first direction and unlocked from the frame plate of the imaging device following completion of the pin segments travelling along the camming profiles in the second direction so that the pin segments are aligned with the opening of the frame plate, thereby allowing the fuser assembly to be removed from the imaging device.

In another example embodiment, an access door of the imaging device includes at least one feature protruding from an inner surface thereof. Each feature on the access door is positioned along the access door for contacting and driving at least one of the fuser handles to a locked position for locking the fuser assembly as the access door is closed. During closure of the access door, the pin segments complete travelling about the imaging device frame plate and lock the fuser assembly with the frame plate. In another embodiment, the feature on the access door contacts and drives the handle from the partial or fully locked position to the unlocked position as the access door is opened, allowing the fuser assembly to be unlocked from the frame plate and removed from the imaging device.

BRIEF DESCRIPTION OF THE DRAWINGS

The above-mentioned and other features and advantages of the disclosed example embodiments, and the manner of attaining them, will become more apparent and will be better understood by reference to the following description of the disclosed example embodiments in conjunction with the accompanying drawings, wherein.

DETAILED DESCRIPTION

Figure 1A:
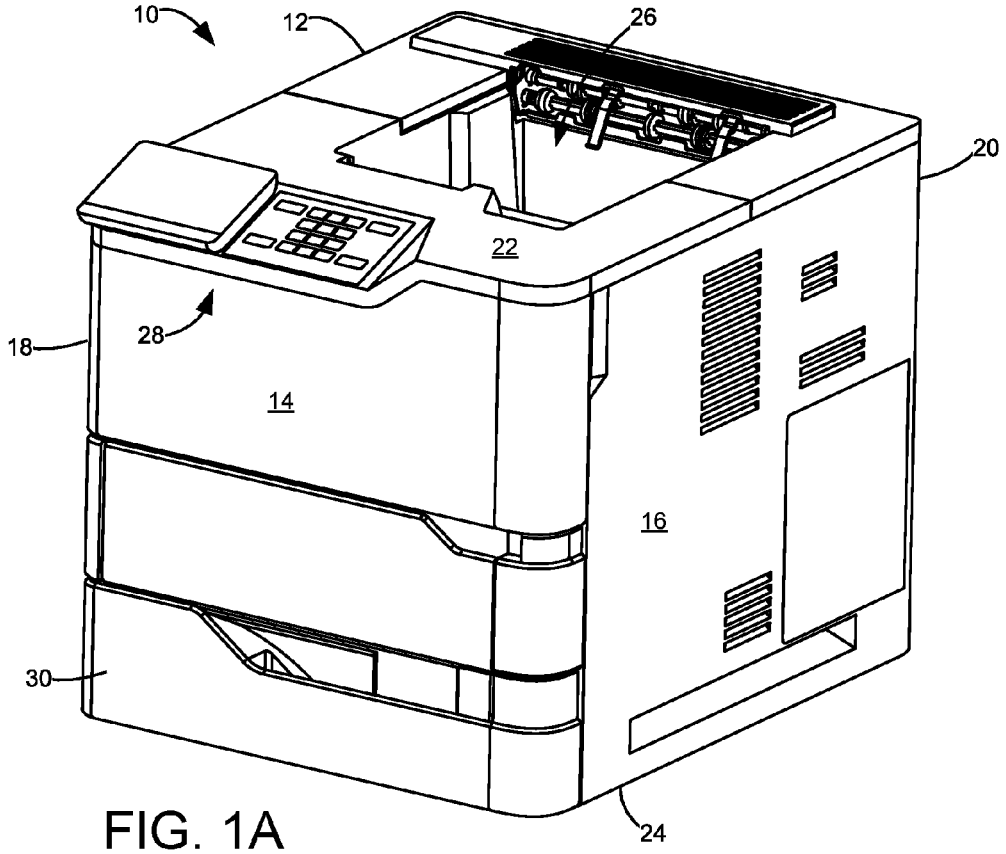
FIGS. 1A and 1B are front and rear perspective views of an imaging device according to an example embodiment, respectively.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positions. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

Figure 1B:
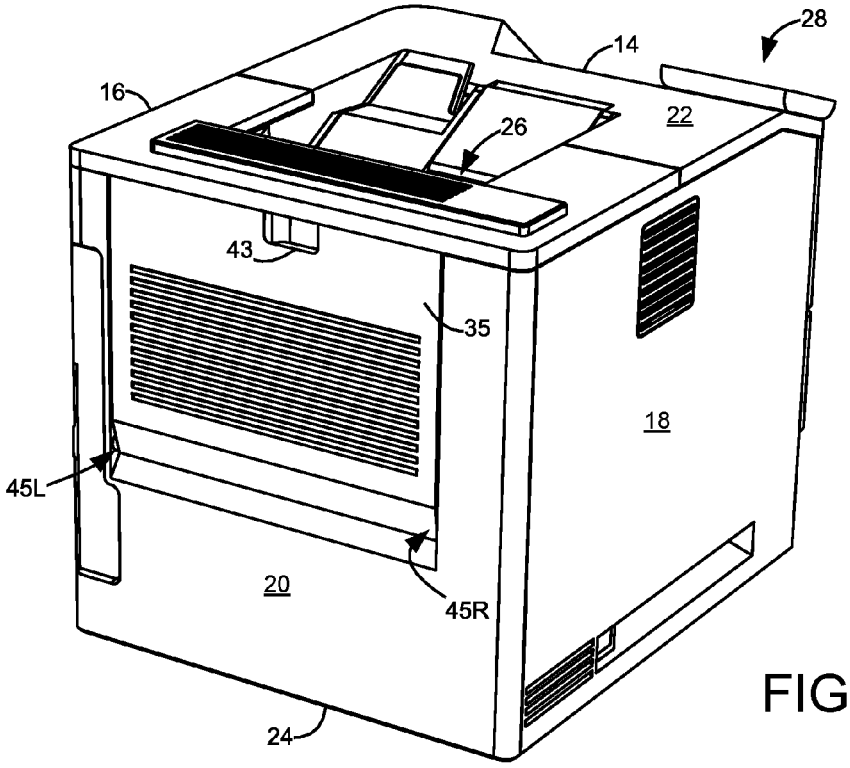

FIGS. 1A and 1B are front and rear perspective views, respectively, of an imaging device 10. Imaging device 10 includes a housing 12 having a front 14, first and second sides 16 and 18, a rear 20, a top 22 and a bottom 24. A media output area 26 is provided on top 22 for printed media exiting imaging device 10. A user interface 28 is provided along top 22 of imaging device 10 for receiving user input on imaging operations to be performed on imaging device 10. A removable media tray 30 for providing media to be printed is slidably inserted into imaging device 10 through an opening provided along front 14. A rear access door 35 is provided on rear 20. A door release 43 may be provided along a top portion of door 35 for allowing user access into the interior of imaging device 10 in order to clear a jammed sheet of media from the media path within imaging device 10 or to replace worn components thereof. Pivot posts 45L, 45R are provided along a bottom portion of door 35 for mounting door 35 on rear 20 of imaging device 10 and for covering the interior of imaging device 10.

Figure 2:
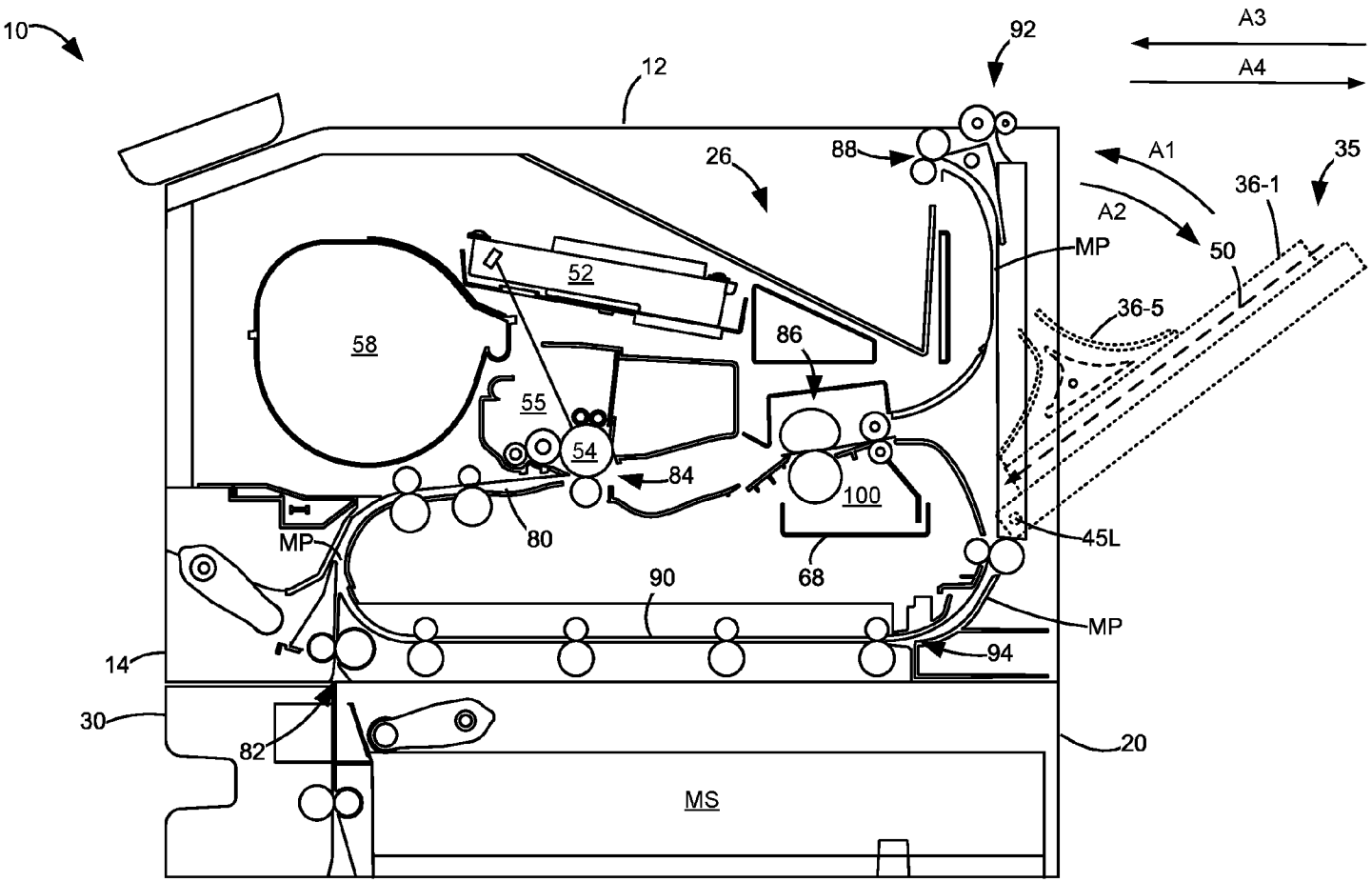
FIG. 2 is a simplified schematic diagram showing components of the imaging device in FIGS. 1A and 1B.

FIG. 2 is a simplified schematic diagram of imaging device 10. Imaging device 10, an electrophotographic imaging device, includes a laser writing unit 52 which creates a latent image on a charged photoconductive member 54 in an imaging unit 55. A toned image corresponding to the latent image is formed on photoconductive member 54 using toner supplied by a toner bottle 58. The toned image is transferred from photoconductive member 54 to a media sheet picked from a media stack MS at a transfer nip formed in part by photoconductive member 54, through which the media sheet passes. The media sheet then passes through a removable fuser assembly 100 whereupon the toner particles forming the toned image are fused to the media sheet by application of heat and pressure. The media sheet is then moved to media output area 26. Relative to the view provided by FIG. 2, a media path MP of the media sheet, as it is moved from media stack MS to media output area 26, has an inverted S-shape. The process of forming printed media using electrophotography is well known in the art such that details will not be provided for reasons of expediency.

FIG. 2 further shows movement of door 35 relative to pivot posts 45R, 45L (FIG. 1B) mounted thereof on rear 20 of imaging device 10. When open, door 35 provides access to portions of media path MP in imaging device 10. A simplex portion 80 of media path MP extends from an entrance 82 located adjacent to media tray 30 through the transfer nip, an imaging area 84, a fusing area 86 in which fuser assembly 100 is disposed, and an exit nip 88 to media output area 26. A duplex path portion 90 of media path MP includes an entrance 92 adjacent to exit nip 88 of simplex portion 80 and an exit 94 which merges with simplex portion 80 just downstream of entrance 82 thereof.

Portions of door 35 form part of simplex portion and duplex path portions 80, 90, respectively, of media path MP. As shown in FIG. 2, an inner surface 36-1 of door 35 includes a protruding portion 36-5 having a set of media guide ribs (not shown) cantilevered from top and bottom portions of door 35. Door 35 further includes a slot 50 extending from a top to a bottom edge thereof. In FIG. 2, portion 36-5 forms a portion of simplex portion 80 while slot 50 forms a portion of duplex path portion 90 of media path MP. Door 35 is movable towards a closed position along direction A1 and towards an open position along direction A2. When closed, door 35 orients media path MP for moving a media sheet as part of a printing operation. Fusing area 86 which includes removable fuser assembly 100 (FIGS. 3A-3D) are positioned nearby door 35. When door 35 is fully opened to allow access to the interior of imaging device 10, fuser assembly 100 may either be moved towards imaging device 10 for installation on fusing area 86 along direction A3, or unlocked and/or removed from imaging device 10, along direction A4. Fusing area 86 includes a receiving plate 68 for receiving fuser assembly 100 when installed in imaging device 10, as will be discussed in greater detail below with respect to at least FIGS. 4 and 5A-5C.

Figure 3A:
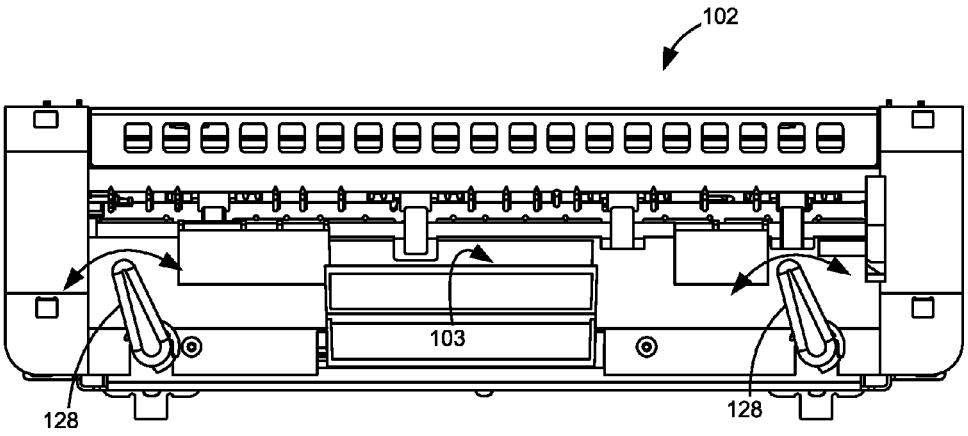
FIGS. 3A and 3B are rear and side perspective views, respectively, of a removable fuser assembly for the imaging device in FIGS. 1A and 1B, according to an example embodiment.
Figure 3B:
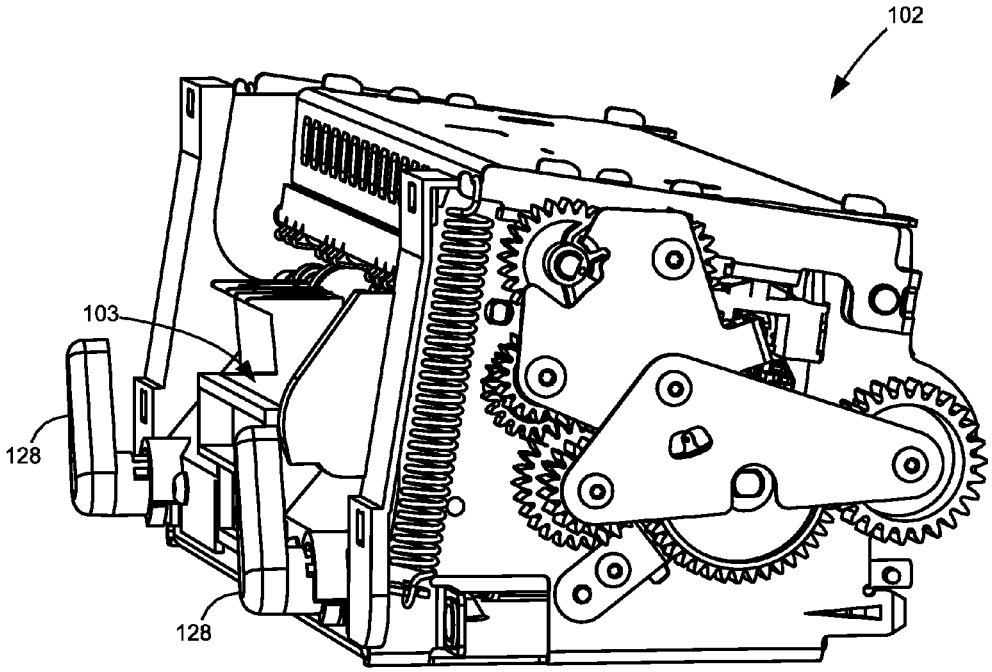
Figure 3C:
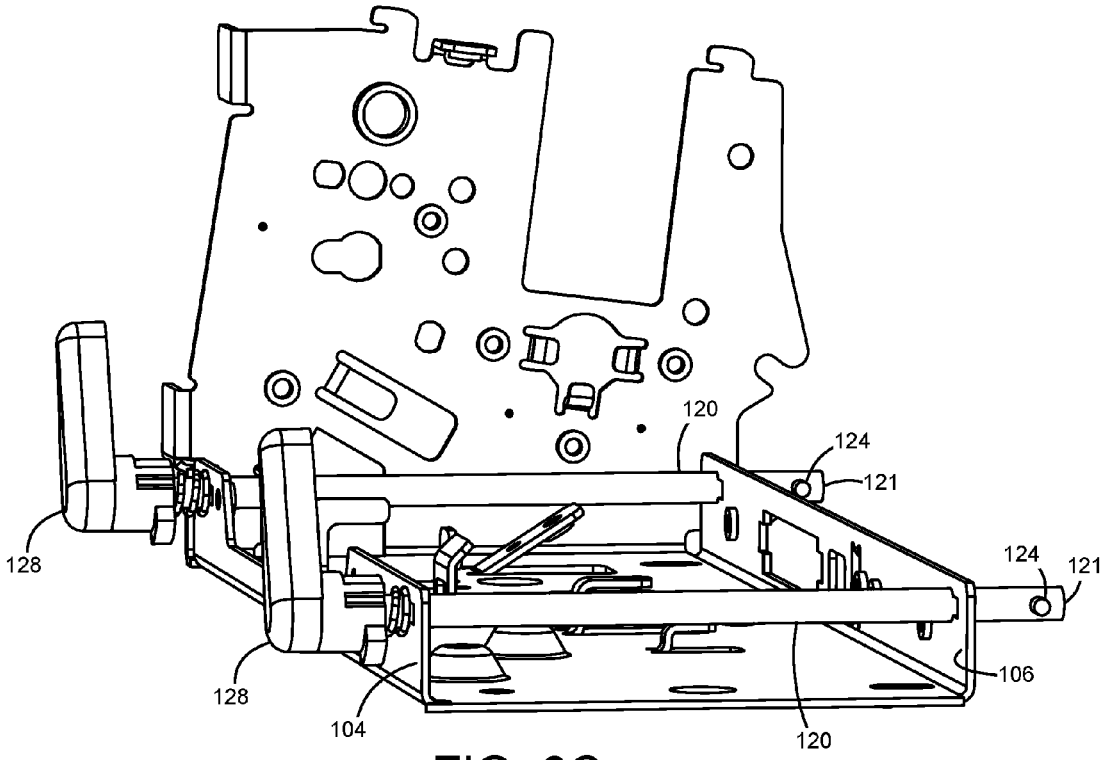
FIG. 3C is a cutaway perspective view of FIG. 3B.
Figure 3D:
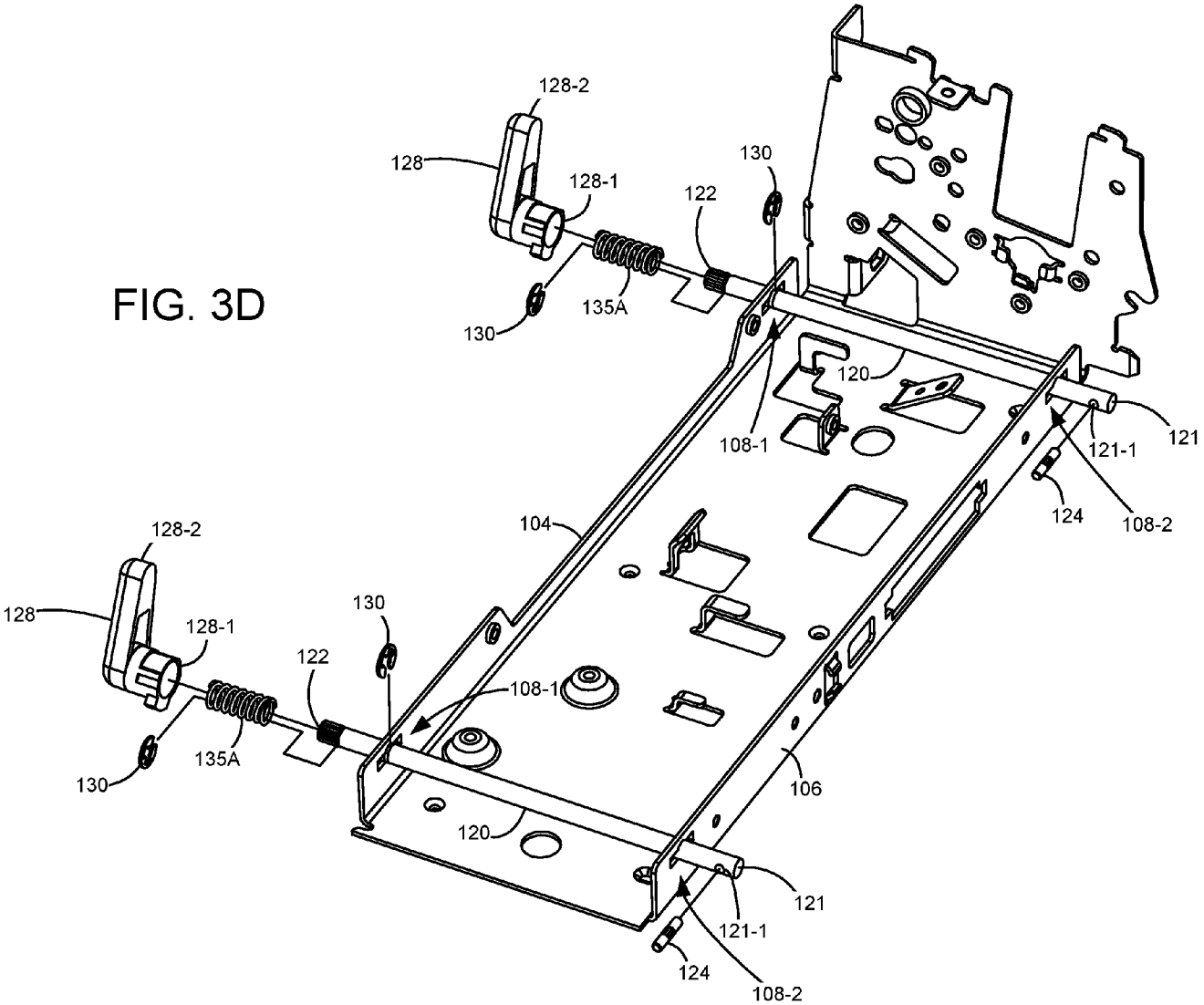
FIG. 3D is an exploded perspective view of a locking mechanism for the fuser assembly in FIGS. 3A and 3B, according to an example embodiment.

FIGS. 3A-3D show different views of fuser assembly 100. In FIGS. 3A-3D, fuser assembly 100 includes a housing 102 having a top, bottom, opposing sides, and front and rear portions for defining a volume for one or more components to fuse toner to a media sheet. The front portion of housing 102 includes a grip 103 for grasping by users in installing and removing fuser assembly 100 to and from fusing area 86 of imaging device 10, respectively, as shown in FIG. 2. In FIGS. 3C and 3D, front and rear portions of housing 102 each includes, respectively, back and front plates 104 and 106, as viewed along the printing direction in FIG. 2. In FIG. 3D, back plate 104 includes a pair of openings 108-1 and front plate 106 includes a pair of openings 108-2 along respective longitudinal end portions thereof. A pair of mounting shafts 120 extends between front plate 106 and back plate 104 through openings 108-1, 108-2.

As shown in FIG. 3D, a first end 121 of each mounting shaft 120 includes a pin member 124, and a second end 122 of each mounting shaft 120 includes a handle 128. Each handle 128 is rotatable in a first direction and in a second direction opposite the first direction (indicated by rotational arrows in FIG. 3A) to impart similar rotation to a corresponding mounting shaft 120. With each mounting shaft 120 inserted through openings 108-1, 108-2, first end 121 of each mounting shaft 120 is cantilevered from front plate 106 while second end 122 of mounting shaft 120 is cantilevered from back plate 104.

Still in FIG. 3D, first end 121 of each mounting shaft 120 includes a through-hole 121-1 in which pin member 124 is inserted. Pin member 124 includes a pair of radially extending segments 125A, 125B (collectively referred to as segments 125 thereafter) equally disposed about first end 121 (FIGS. 8B, 9B, 10B) and extending from through-hole 121-1. Pin member 124 may be integrally made with each mounting shaft 120 as a unitary member. Pin member 124 is constructed from a rigid material, such as a rigid plastic or metal. First end 121 of each mounting shaft 120 along with segments 125 are receivable through a pair of openings 69 on receiving plate 68 (FIG. 4) during installation of fuser assembly 100 in imaging device 10.

Each handle 128 includes a first portion 128-1 and a second portion 128-2. First portion 128-1 is a hollow portion into which second end 122 of a corresponding mounting shaft 120 is inserted. Second portion 128-2 extends from first portion 128-1 for either manual manipulation by a user or engaging with door 35, as discussed in detail below. Rotation of each handle 128 in the first and the second directions as indicated by the rotational arrows in FIG. 3A causes mounting shaft 120 coupled therewith to rotate similarly. Accordingly, rotation of each mounting shaft 120 in either direction causes a corresponding pin member 124 to also rotate.

Figure 3E:
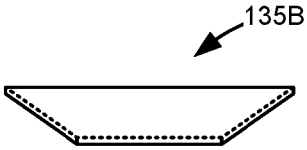
FIGS. 3E and 3F are side and perspective views, respectively, of a biasing mechanism for the locking mechanism in FIG. 3D, according to an additional example embodiment.
Figure 3F:
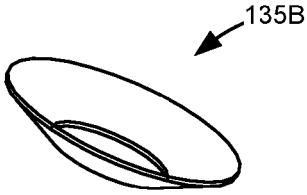
Figure 3G:
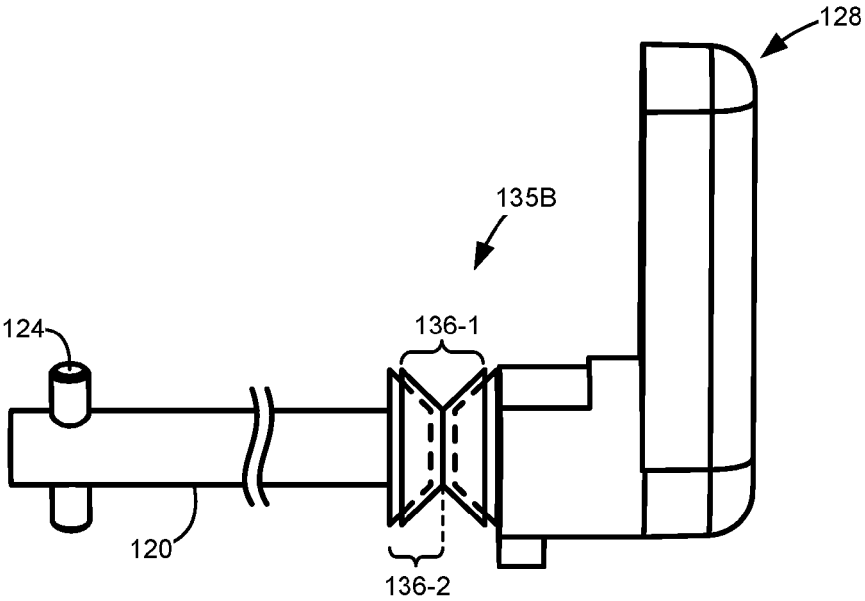
FIG. 3G shows the biasing mechanism of FIGS. 3E and 3F as arranged in the fuser assembly, according to an additional example embodiment.

As will be known in the art, fuser assembly 100 may include at least one retainer 130 for limiting movement of each mounting shaft 120 in the axial direction, such as e-clips (FIG. 3D). In the present disclosure, fuser assembly 100 includes a biasing mechanism which maintains pin member 124 biased towards front plate 106 of housing 102. In one example embodiment, the biasing mechanism may be a biasing member disposed about mounting shaft 120 between back plate 104 and first portion 128-1 of handle 128. For example, in FIG. 3D, the biasing member is a compression spring (labelled 135A). Alternatively and as shown in FIG. 3G, biasing member is a stack of Belleville washers (each labelled as 135B) arranged in series and/or parallel to each other between back plate 104 and first portion 128-1 of handle 128. FIGS. 3E and 3F show side and perspective views of a Belleville washer 135B, respectively, according to an example embodiment. For purposes of illustration, FIG. 3G shows three Belleville washers 135B stacked together along second end 122 of mounting shaft 120, with a first pair of washers labelled 136-1 arranged on series and a second pair of washers labelled 136-2 arranged parallel to each other.

Figure 3H:
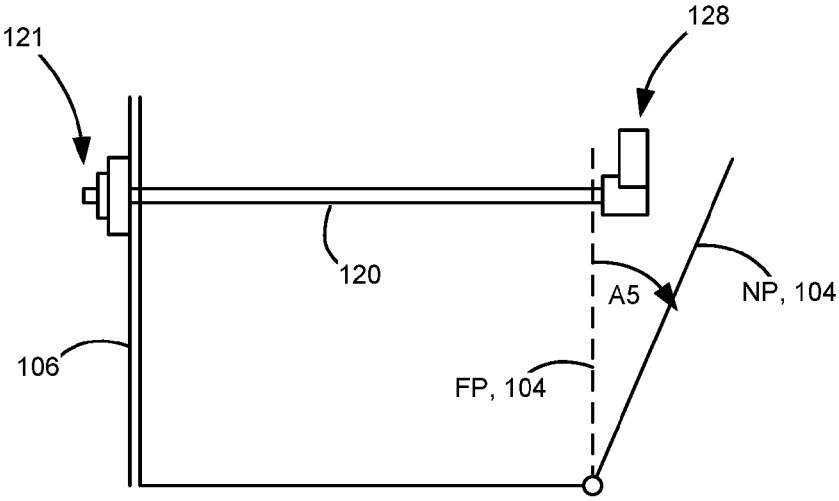
FIG. 3H shows a biasing mechanism for the locking mechanism for the fuser assembly in FIGS. 3A and 3B, according to another additional example embodiment.

It is understood that the biasing mechanism may be implemented in other ways. For example, FIG. 3H shows a back plate 104, or a portion thereof, of housing 102, according to another example embodiment. In FIG. 3H, back plate 104 is disposed at an obtuse angle relative to a floor portion of the housing 102 in natural position NP prior to assembly of fuser assembly 100 and is resiliently bent towards front plate 106 of housing 102. The engagement with mounting shafts 120, pin member 124, and handles 128 with back plate 104 causes back plate 104 to be forcibly pivoted to a final position FP largely parallel with front plate 106 of housing 102. The resilient nature of back plate 104 to return to natural position NP results in back plate 104 or portion thereof urging handles 128 and pin members 124 in direction A5.

Figure 4:
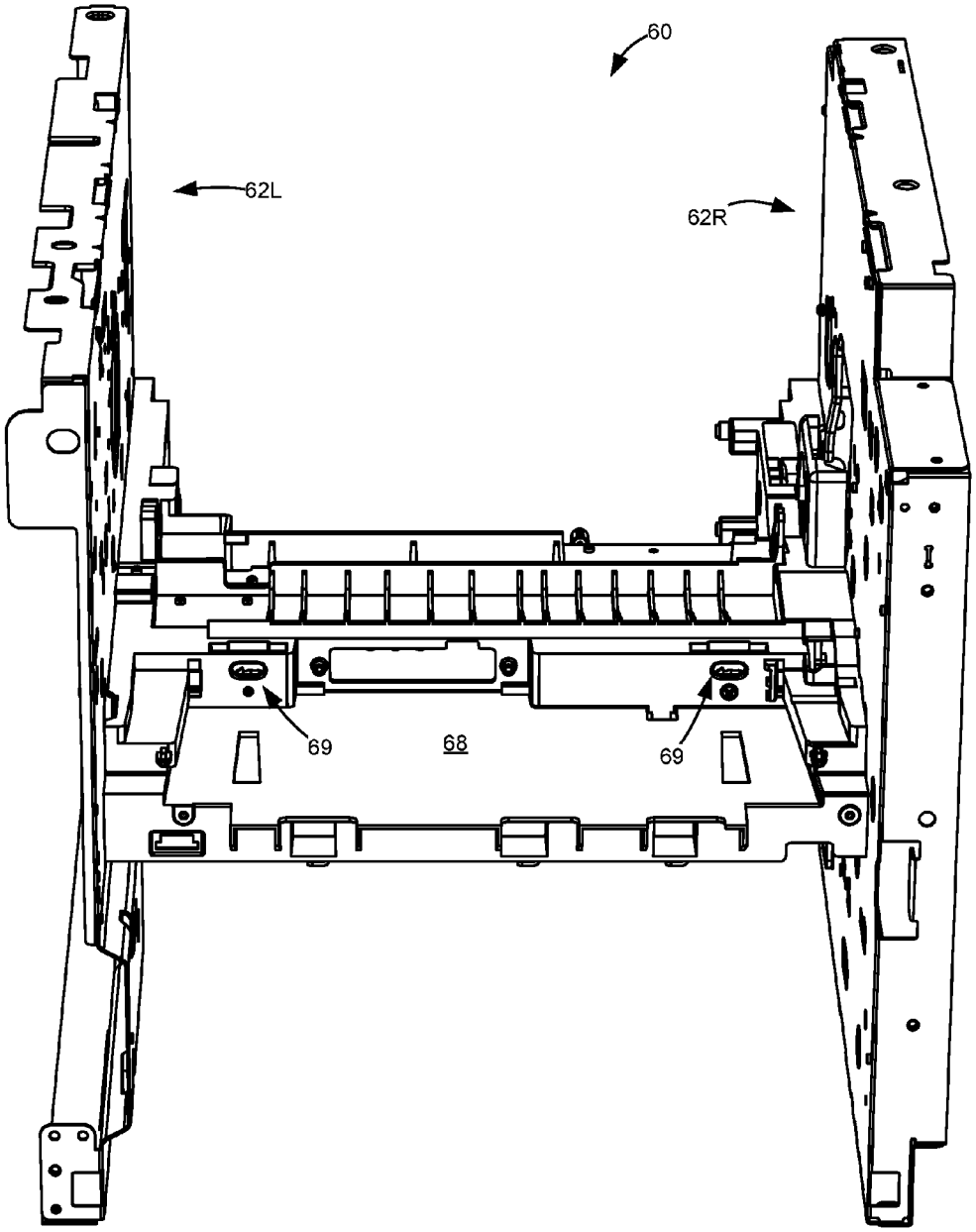
FIG. 4 is a perspective view of the frame of the imaging device in FIGS. 1A and 1B.

FIG. 4 is a perspective view of a frame 60 of imaging device 10. Frame 60 is used to support the internal components of imaging device 10. Frame 60 includes at least left and right side panels 62L, 62R, respectively, as well as a front panel (not shown, for purposes of clarity) that define a volume of imaging device 10 in which the internal components are disposed. Frame 60 also includes plate 68 extending between left and right side panels 62L, 62R. Plate 68 includes the pair of openings 69 disposed along a portion thereof adjacent the interior portion of imaging device 10.

Figure 5A:
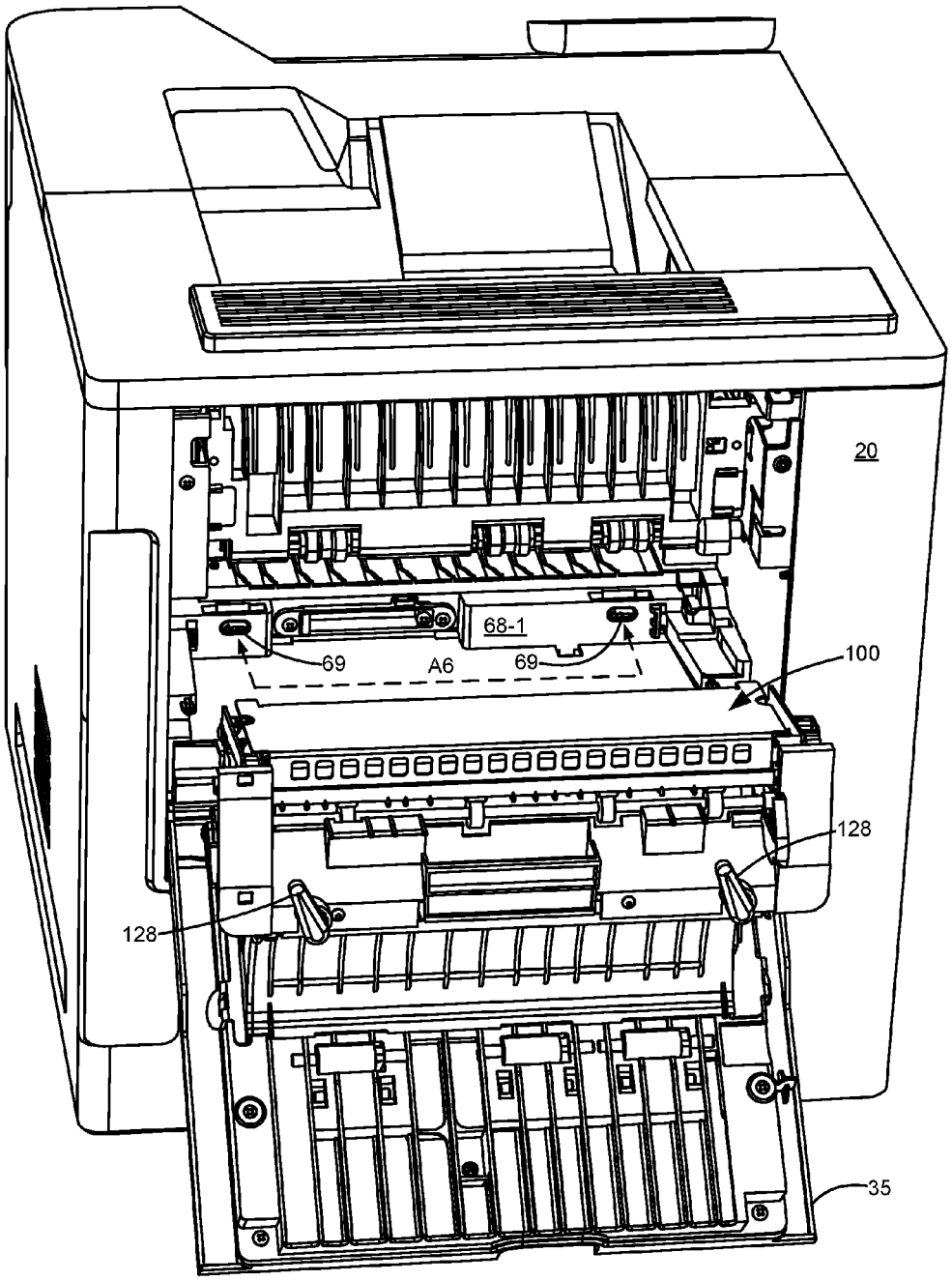
FIG. 5A is a top perspective view of the imaging device in FIGS. 1A and 1B with an access door open and the fuser assembly being installed thereon, according to an example embodiment.
Figure 5B:
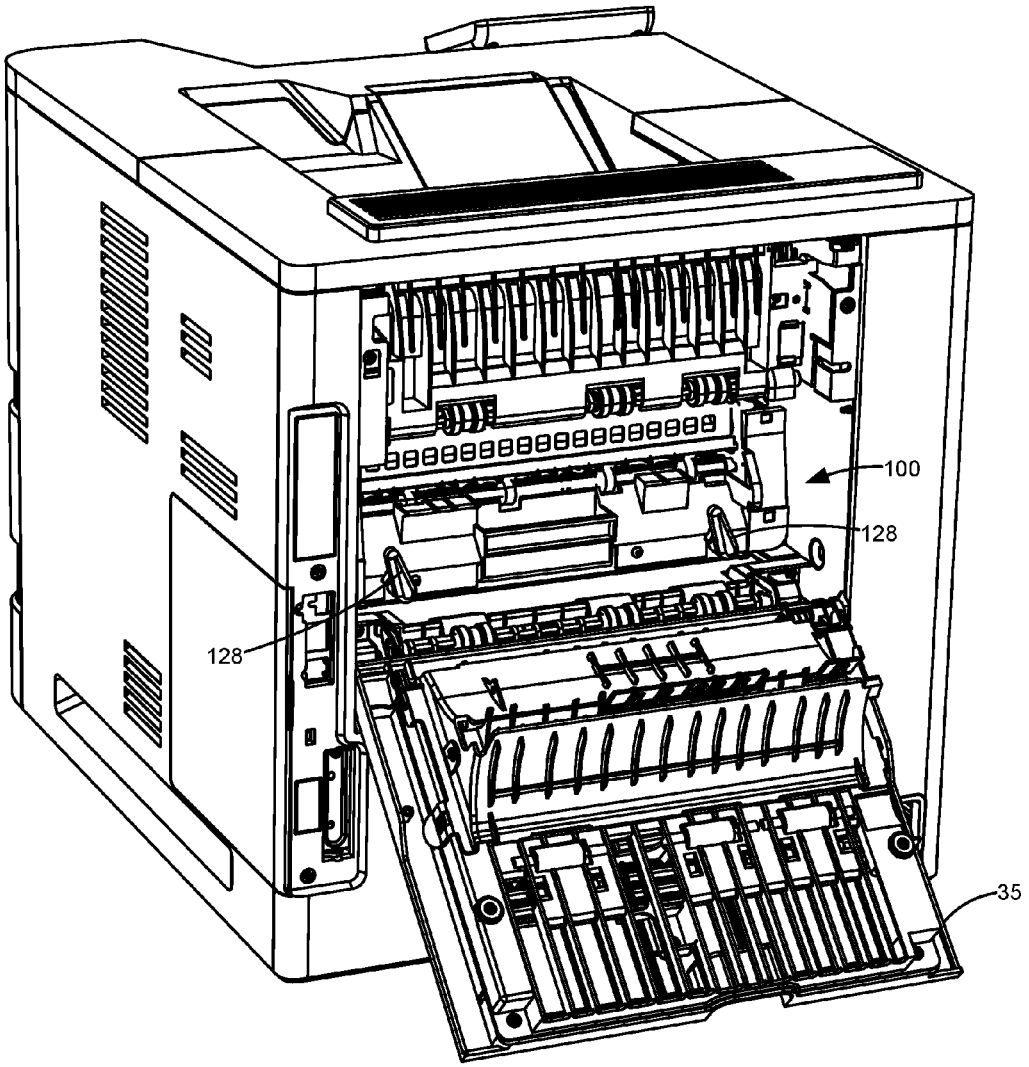
FIGS. 5B and 5C are side perspective views of the imaging device in FIGS. 1A and 1B with the fuser assembly in FIGS. 3A-3B in the operable position.
Figure 5C:
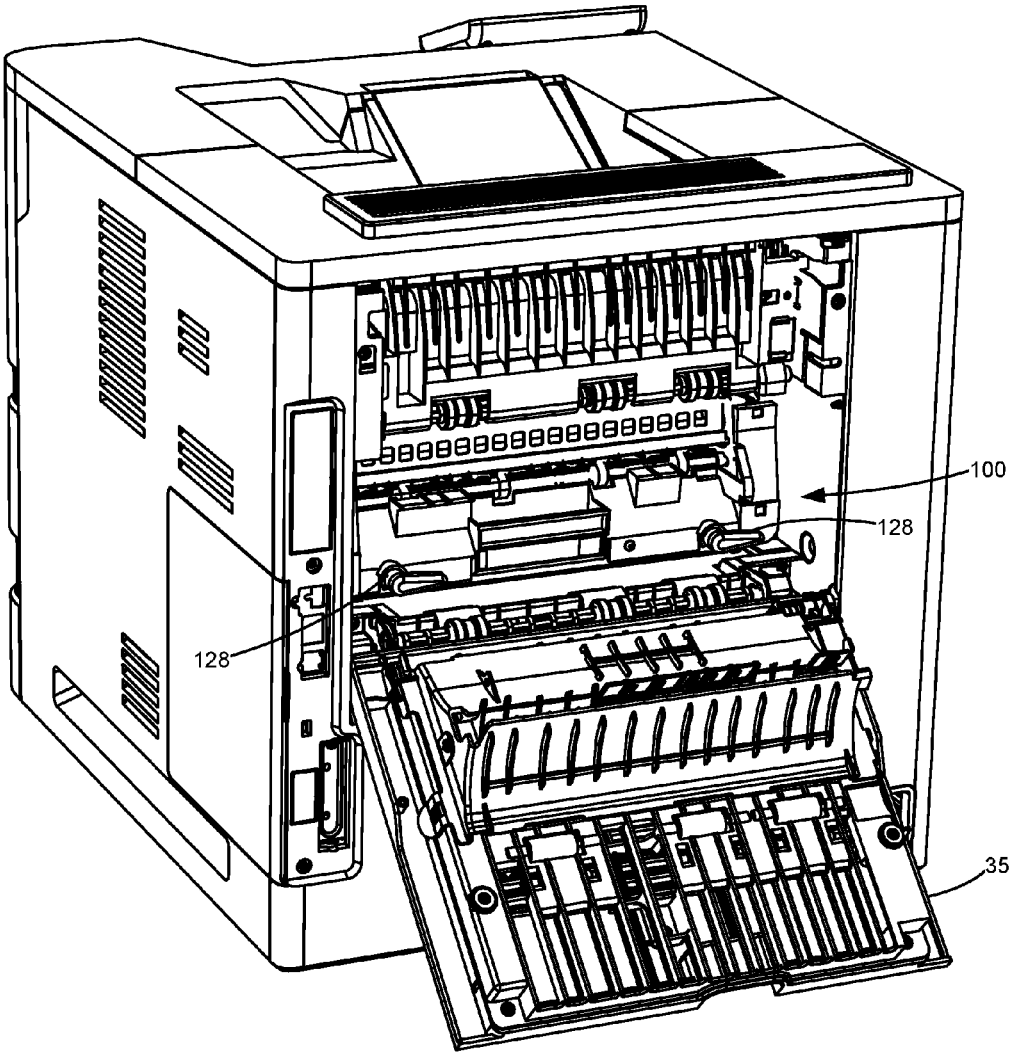

FIGS. 5A-5C show installation of fuser assembly 100 within imaging device 10. In FIG. 5A, fuser assembly 100 is moved towards its operable position in direction A6 (similar to direction A3 in FIG. 2) within imaging device 10. In FIG. 5B, fuser assembly 100 is in an unlocked position within imaging device 10, while in FIG. 5C fuser assembly 100 is in a locked position. In both FIGS. 5B and 5C, fuser assembly 100 is in its operable position. Orientation of handles 128 in FIGS. 5B and 5C indicate a locking engagement between first end 121 of each mounting shaft 120 and openings 69 of plate 68 (FIG. 4), as will be discussed in detail below.

In FIG. 5A, with door 35 at an open position and fuser assembly 100 only partly inserted in imaging device 10, a first side 68-1 of plate 68 is visible. Front plate 106 of fuser assembly 100 is positioned adjacent first side 68-1 of plate 68 when fuser assembly 100 is installed and in its operable position within imaging device 10. While not shown in FIG. 5A, first ends 121 of mounting shafts 120 are aligned with and received by openings 69 of plate 68 when fuser assembly 100 is in its operable position. FIG. 5B shows fuser assembly 100 mounted within imaging device 10 with both handles 128 at unlocked positions similar to positions thereof in FIG. 3A. FIG. 5C shows fuser assembly 100 also mounted within imaging device 10 but with both handles 128 at locked positions for locking fuser assembly 100 in place within imaging device 10. Engagement between each pin member 124 and plate 68 locks fuser assembly 100 in its operable position adjacent media path MP (FIG. 2) as will be discussed below with reference to FIGS. 6A-6C, 7A-7C, and 8A and 8B.

Figure 6A:
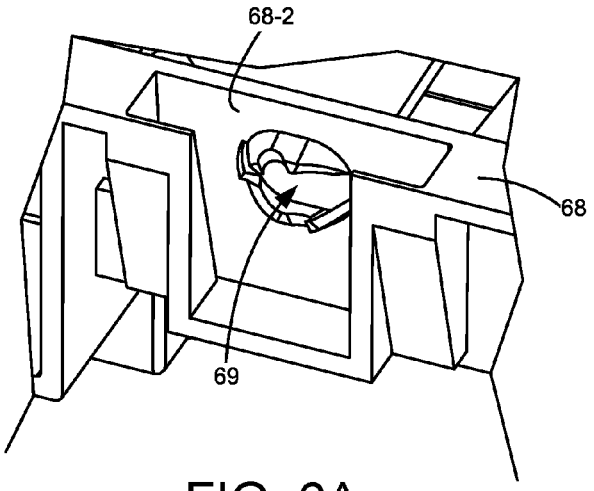
FIGS. 6A-6C are perspective, side elevational and cross-sectional views, respectively, showing a frame plate of the imaging device in FIG. 2, according to an example embodiment.
Figure 6B:
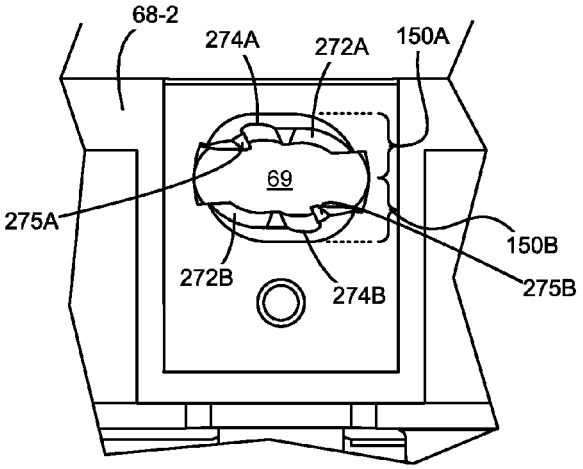
Figure 6C:
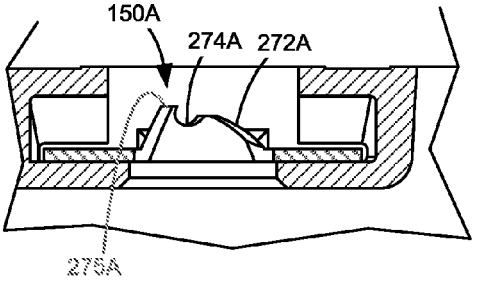

FIGS. 6A-6C show a second side 68-2 of a portion of plate 68 along one of the pair of openings 69, according to an example embodiment. For purposes of clarity, only one of the pair of openings 69 on plate 68 is shown, but it is understood that openings 69 and the areas of second side 68-2 surrounding openings 69 are identical. FIGS. 6A-6C show views of first and second camming profiles 150A, 150B on plate 68. In FIG. 6B, first and second camming profiles 150A, 150B largely surround opening 69. For purposes of discussion, FIG. 6C show a perspective view of first camming profile 150A along opening 69. First and second camming profiles 150A, 150B are largely symmetrical in size and shape. First camming profile 150A extends along an upper portion of opening 69, while second camming profile 150B extends along a lower portion thereof. Camming profiles 150A, 150B include ramped portions 272A, 272B, respectively, that gradually extend outwardly from the planar portion of second side 68-2 of plate 68. First ramped portion 272A extends between a first longitudinal end portion of opening 69 and an opposing second longitudinal end portion above opening 69, while second ramped portion 272B extends between a first and second longitudinal end portions of opening 69 below opening 69. Ramped portions 272A, 272B extend in an arching or curved manner about opening 69. While FIGS. 6A-6C show ramped portions 272A, 272B extending outwardly from respective opposing sides of opening 69, ramped portions 272A, 272B may be extending inwardly relative to the planar portion of second side 68-2 of plate 68 from opening 69.

Camming profiles 150A, 150B may respectively include recess portions or detents 274A, 274B. Each detent 274A, 274B is disposed adjacent an extending end of ramped portions 272A, 272B, respectively, relative to second side 68-2 of plate 68. In one example, when ramped portions 272A, 272B extend outwardly about opening 69, detents 274A, 274B may be disposed adjacent respective outermost extending end portions of ramped portions 272A, 272B. In another example, when ramped portions 272A, 272B extend inwardly relative to opening 269, detents 274A, 274B may be disposed adjacent respective innermost extending end portions of ramped portions 272A, 272B.

Figure 7A:
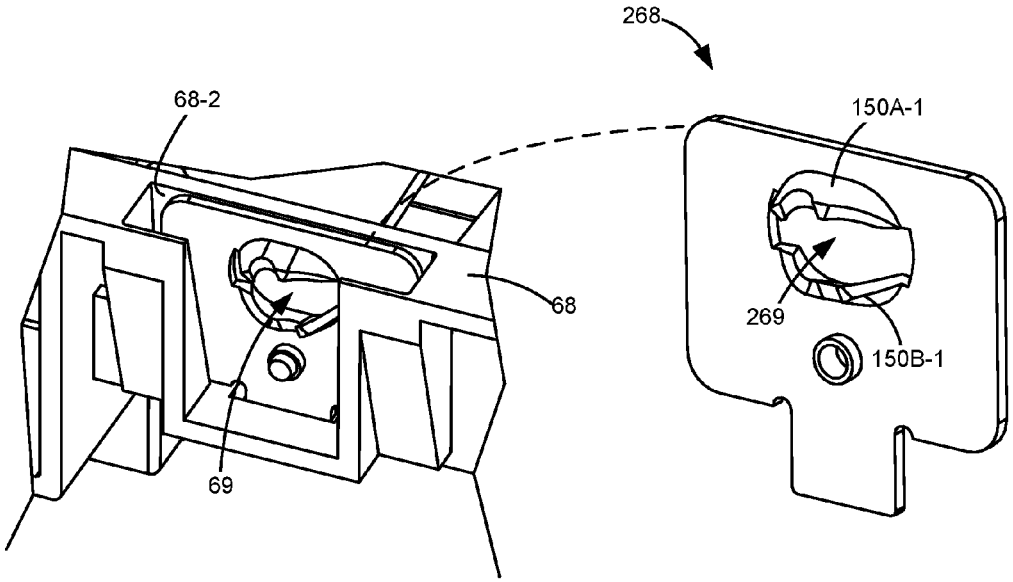
FIGS. 7A-7C show a frame plate of the imaging device, according to additional example embodiments.
Figure 7B:
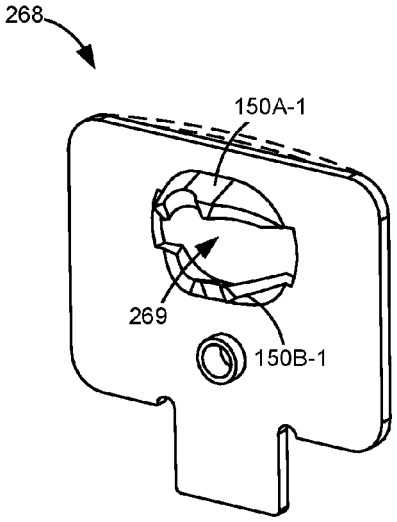
Figure 7C:
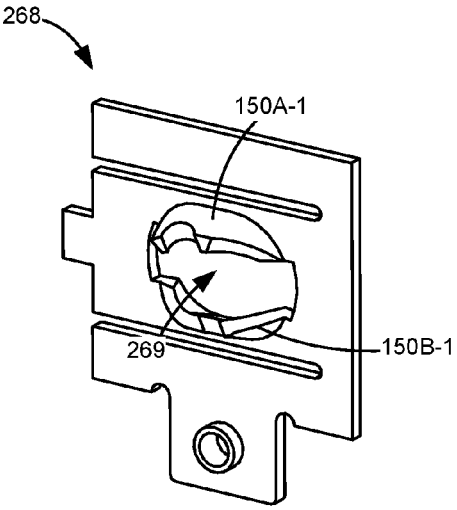

In FIGS. 6A-6C, first and second camming profiles 150A and 150B are integrally formed with plate 68. However, in other example embodiments, camming profiles 150A and 150B are not integrally formed with plate 68. Specifically, imaging device 10 may include a camming plate 268 disposed adjacent second side 68-2 of plate 68, as shown in FIGS. 7A-7C. Camming plate 268 may be removable from plate 68 or permanently fixed thereto. In the example embodiments of FIGS. 7A-7C, second side 68-2 of plate 68 is a flat surface to which plate 268 may be attached.

In FIG. 7A, plate 268 includes an opening or slot 269 aligned with each opening 69 on plate 68 and first and second camming profiles 150A-1, 150B-1. First and second camming profiles 150A-1 and 150B-1 are the same in structure as that of camming profiles 150A and 150B, respectively, discussed above with respect to FIGS. 6A-6C. In FIG. 7A, plate 268 may be made of a rigid metal sheet attached onto second side 68-2 of plate 68. In FIG. 7B, plate 268 may be comprised of a resilient material. In yet another example embodiment in FIG. 7C, a portion of plate 268 surrounding opening 269 including first and second camming profiles 150A-1, 150B-1 may be resilient. Embodiments of plate 268 in FIGS. 7B and 7C may be directly in contact with front plate 106 of fuser assembly 100.

Figure 8A:
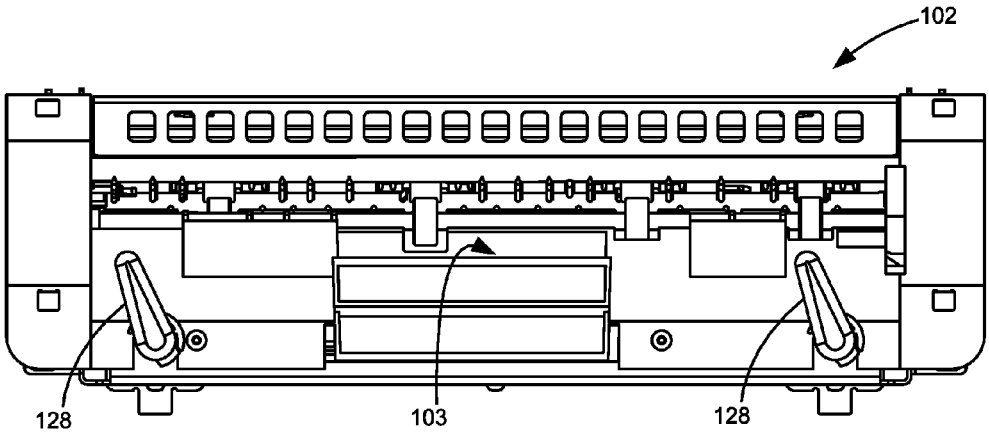
FIGS. 8A, 9A, and 10A are front views of the rear portion of the fuser assembly in FIGS. 3A-3B with handles oriented at different positions.
Figure 8B:
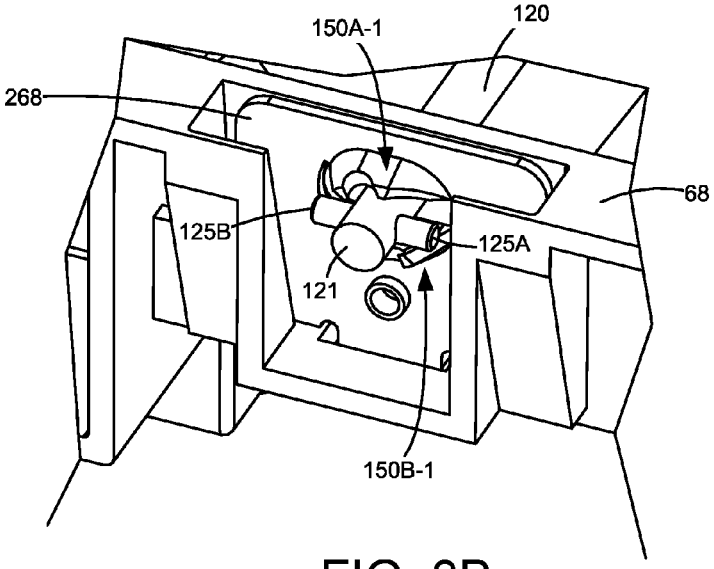
FIGS. 8B, 9B, and 10B are cutaway perspective views of the frame plate of the imaging device showing engagement with a pin member of the fuser assembly according to the handle positions depicted in FIGS. 8A, 9A and 10A, respectively.
Figure 9A:
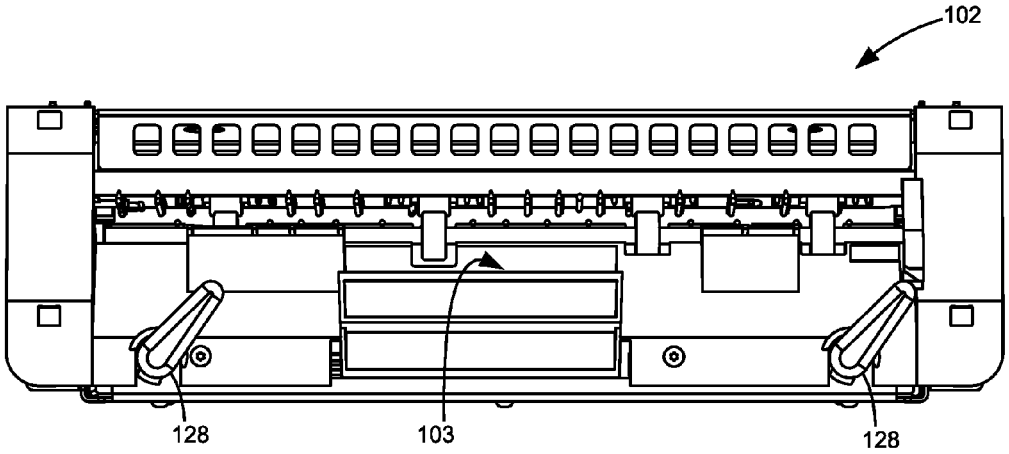
Figure 9B:
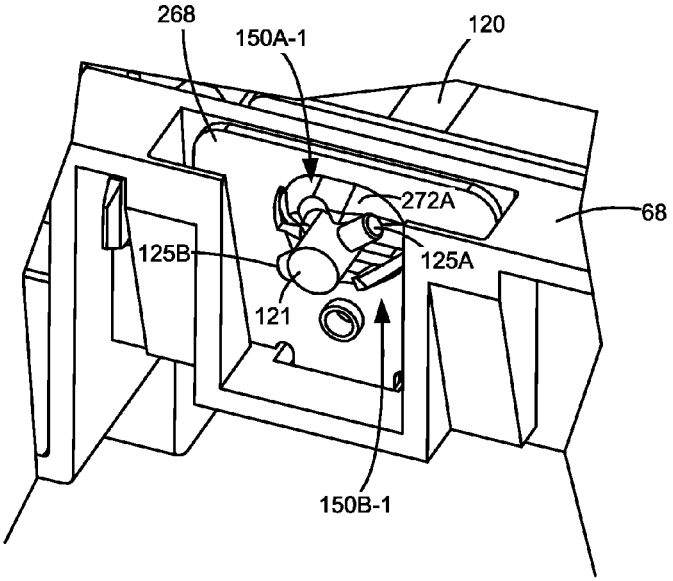
Figure 10A:
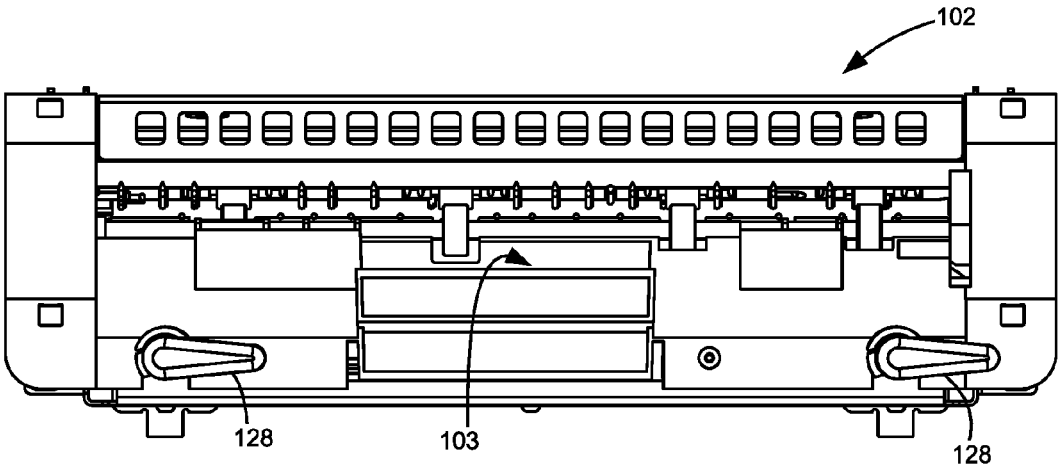
Figure 10B:
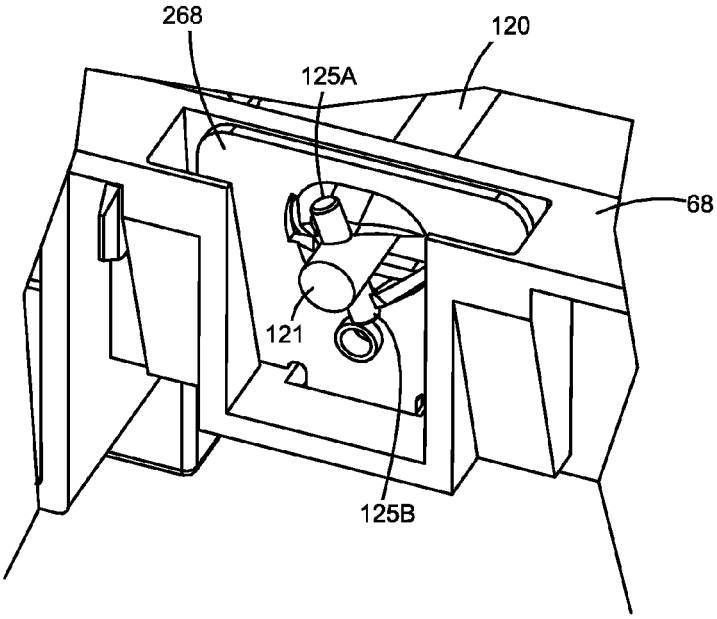

Rotation of handles 128 for locking fuser assembly 100 into its operable position within imaging device 10 will now be described with reference to FIGS. 8A-8B, 9A-9B, and 10A-10B. FIGS. 8A, 9A, and 10A show front views of fuser assembly 100 with handles 128 oriented at different positions. FIGS. 8B, 9B, and 10B show cutaway perspective views of second side 68-2 of plate 68 engaging with first end 121 of each mounting shaft 120.

In FIGS. 8A, 9A, and 10A, each handle 128 may be rotatable along the first and second directions at a predetermined fraction of a revolution thereof. In one example embodiment in FIGS. 8A, 9A and 10A, handle 128 may be rotatable between about 0 degrees (FIG. 10A, corresponding to the locked position) and about 120 degrees (FIG. 8A, corresponding to the fully unlocked position). For purposes of the present disclosure and not by way of limitation, a first position and a third position of handle 128 may be when it is oriented at 120 degrees and at 0 degrees, respectively. Additionally, a second position of handle 128 may be when it is oriented at an angle anywhere between 0 and 120 degrees. Since rotation of mounting shaft 120 is consequential to rotation of handle 128 and pin member 124, the first, second, and third positions of handle 128 respectively show the specific manner of engagement between pin member 124 and plate 268. FIG. 8A shows handle 128 being in the first or unlocked position in which fuser assembly 100 may be removed from imaging device 10. FIG. 9A shows handle 128 being in the second or partially locked position in which fuser assembly 100 cannot be removed from imaging device 10. FIG. 10A shows handle 128 being in the third or fully locked position. In FIGS. 8A, 9A, and 10A, fuser assembly 100 is in its operable position within imaging device 10. In other example embodiments, fuser assembly 100 may only be in the operable position when handles 128 are positioned in the fully locked position as shown in FIG. 10A.

As mentioned, FIG. 8A shows handles 128 in the unlocked position. Handle 128 may be oriented in the unlocked position on fuser assembly 100 prior to mounting fuser assembly 100 within imaging device 10. Positioning handle 128 in the unlocked position as that shown in FIG. 8A aligns segments 125 with openings 69, 269 on plates 68, 268, as shown in FIG. 8B, so that first end 121 of mounting shaft along with segments 125 may be inserted through openings 69, 269 for subsequent engagement therewith. With segments 125 aligned with openings 69, 269 on imaging device 10, fuser assembly 100 is in an unlocked position with respect to frame 60 (FIG. 4) and with door 35 in the open position, is therefore removable from imaging device 10 in the direction A4 shown in FIG. 2.

In one example embodiment, handle 128 may be initially only movable towards the locking position. From the example initial position as viewed in FIG. 8A, handle 128 can only be rotated in the clockwise direction. In this context, one or more interferences may be provided adjacent ramped portions 272A, 272B to prevent segments 125 from travelling along respective ramped portions 272A, 272B and therefore preventing handles 128 from being rotated in a predetermined direction (i.e., counterclockwise) once fuser assembly 100 is inserted within imaging device 10. The one or more interferences may be end portions 275A, 275B of, respectively, detents 274A, 274B adjacent opening 69 (FIGS. 6B and 6C).

FIG. 9A shows handles 128 in the partially locked position. From the partially locked position, handle 128 may be rotated either counterclockwise to the first position (FIG. 8A) or clockwise to the third position (FIG. 10A). From the unlocked position (FIG. 8A), rotation of handle 128 in the clockwise direction (as viewed from FIG. 8A) causes segments 125A, 125B to travel in the counterclockwise direction, as viewed in FIG. 9B and to move from being aligned with openings 69, 269 to an approximate midpoint along ramped portions 272A, 272B (FIG. 9B). From the fully locked position (FIG. 10A), rotation of handle 128 in the counterclockwise direction causes segments 125A, 125B to travel in the clockwise direction, as viewed from FIG. 9B, and out of respective detents 274A, 274B to the approximate midpoint along ramped portions 272A, 272B.

FIG. 10A shows handles 128 in the fully locked position. Rotation of handle 128 in the clockwise direction, as viewed from FIG. 9A, causes segments 125A, 125B of pin member 124 to travel along ramped portions 272A, 272B in a counterclockwise direction, as viewed from FIG. 9B, until the segments 125A, 125B are received in respective detents 274A, 274B, respectively, as shown in FIG. 10B. With segments 125A, 125B received in the corresponding detents on plate 268, first end 121 of each mounting shaft 120 is prevented from being moved further in the counterclockwise direction. Detents 274A, 274B are sized and shaped such that pin segments 125A, 125B remain engaged therewith until handles 128 are rotated in the opposite or counterclockwise direction (relative to FIG. 10A) to unlock fuser assembly 100 and allow removal thereof from imaging device 10.

Figure 11:
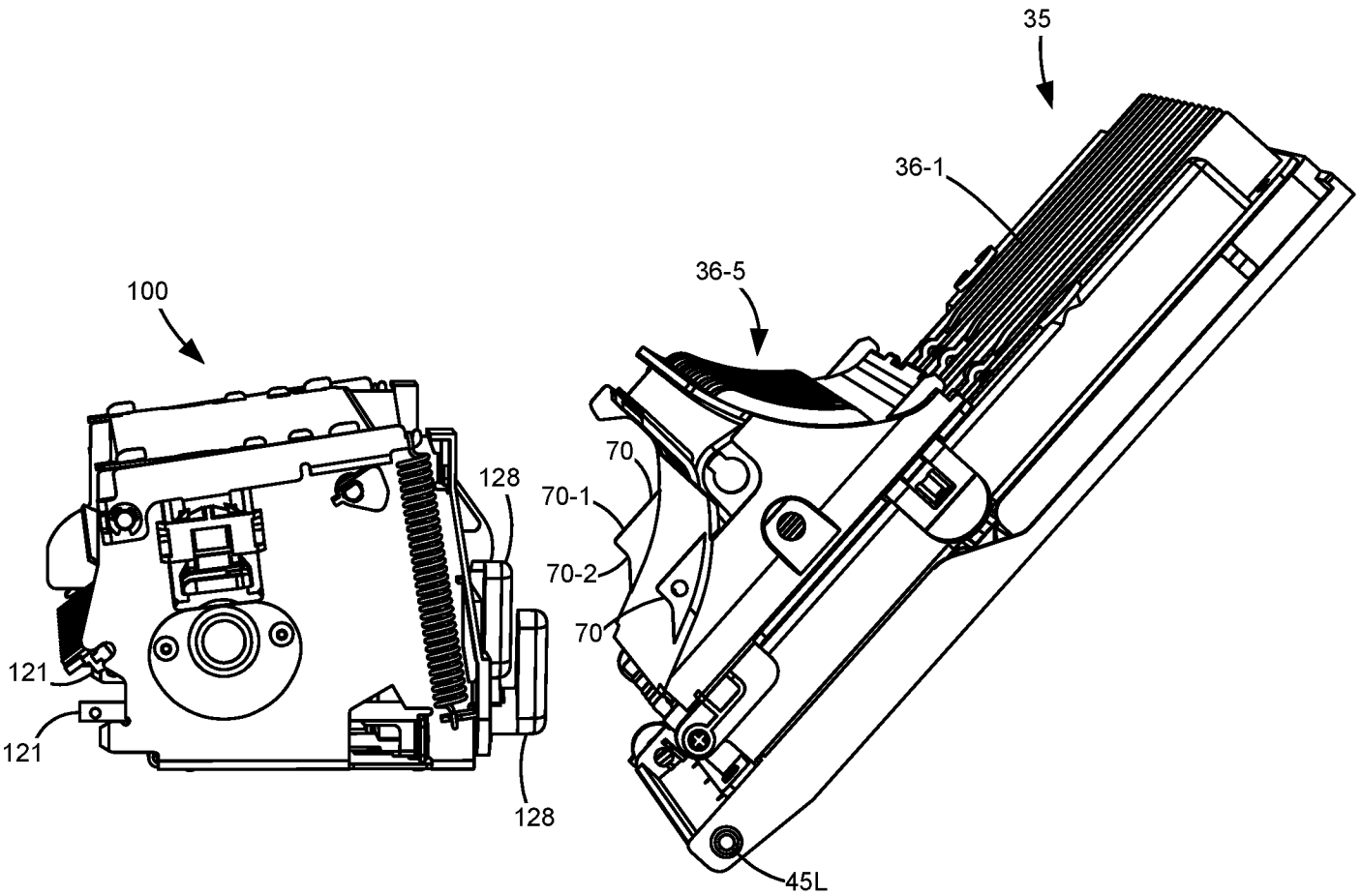
FIG. 11 is a side perspective view of the fuser assembly in FIGS. 3A and 3B and the access door in FIG. 1B, according to an example embodiment.

FIG. 11 shows a side perspective view of fuser assembly 100 and door 35. In FIG. 11, door 35 is oriented in an open position to show a pair of features 70 disposed on inner surface 36-1 of door 35 and along a bottom portion thereof. Features 70 may be, for example, ribs, fins, or other like protrusions. Door 35 may be moved in the closed or open position by grasping door release 43 (FIG. 1). Moving door 35 in either position also moves features 70 to cause engagement with handles 128.

In one example embodiment, each feature 70 includes a first portion 70-1 and a second portion 70-2. First portion 70-1 engages with at least one of the pair of handles 128 when handles 128 are in the unlocked position (FIG. 8A) or are in the partially locked position (FIG. 9A). In particular, when handles 128 are in the unlocked position (in FIG. 8A), moving door 35 towards the closed position in direction A1 (FIG. 2) also moves features 70 and causes features 70 to contact handle 128. Door 35 is prevented from being fully closed as first portions 70-1 of features 70 contacts with the front portions of handle 128. Similarly, when handles 128 are in the partially locked position (FIG. 9A), moving door 35 towards the closed position also moves features 70 and causes features 70 to contact front portions of handle 128. Still, door 35 is prevented from being fully closed when handles 128 are oriented in the partially locked positions as features 70 are interfered by front portions of handles 128. Second portion 70-2 is illustrated as a curved surface engaging with at least one of the pair of handles 128 when the handles are in (or close to) the fully locked position (FIG. 10A).

Figure 12B:
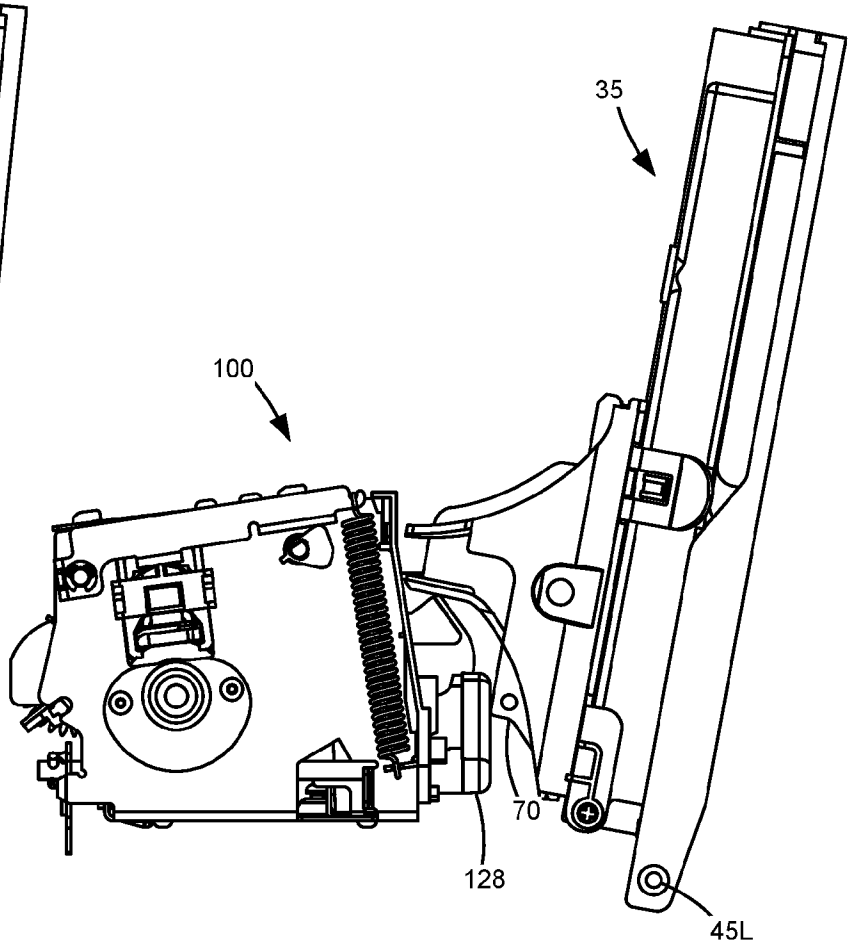
FIGS. 12A-12C are side views of the fuser assembly in FIGS. 3A and 3B and the access door in FIG. 1B illustrating a rear access door being closed, according to an example embodiment.
Figure 12A:
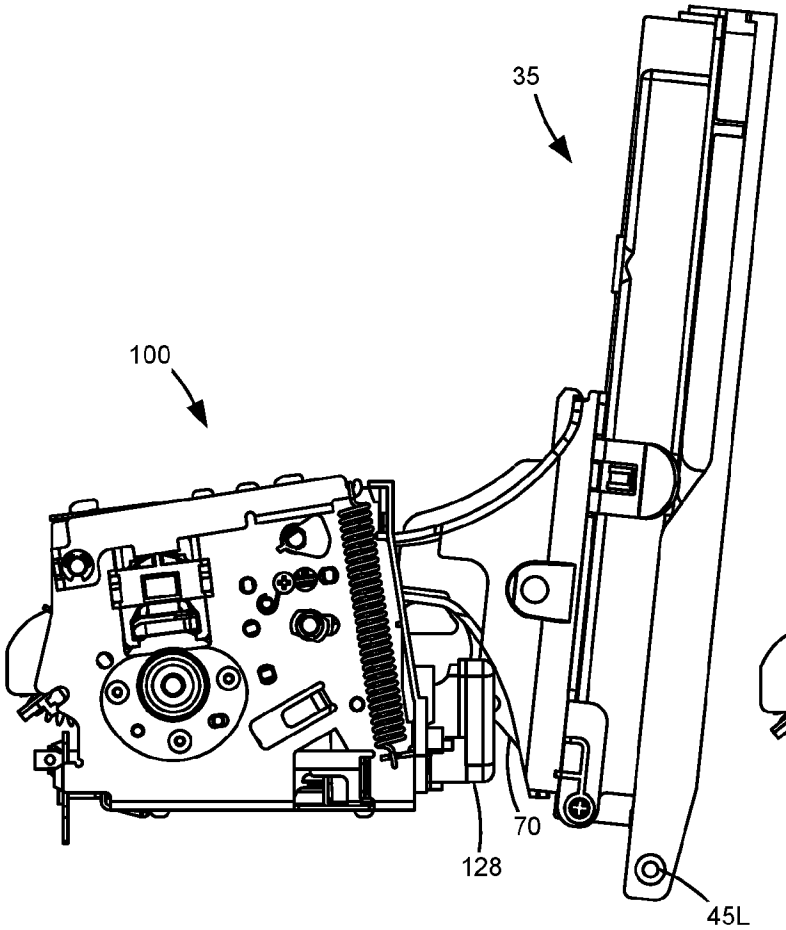
Figure 12C:
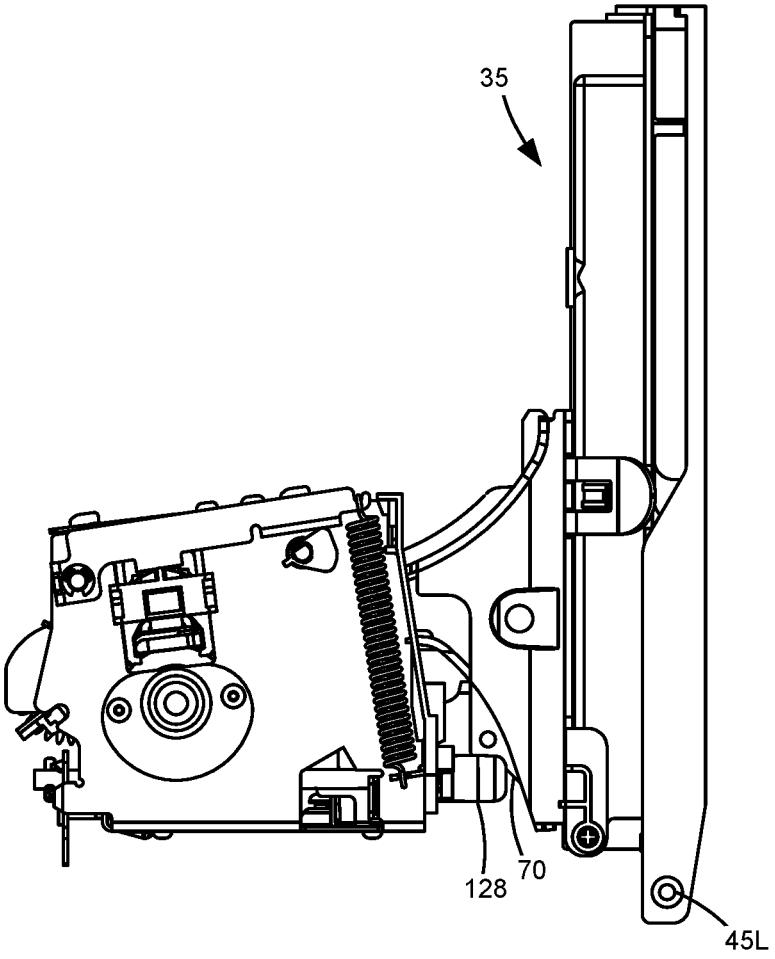

FIGS. 12A-12C illustrate the engagement between handles 128 and features 70 as door 35 is closed. In FIGS. 12A and 12B, features 70 contact handles 128 and prevent door 35 from being closed. With reference to FIG. 11, first portions 70-1 of features 70 directly contact with front portions of handles 128 and prevents door 35 from being closed in FIGS. 12A and 12B. In FIGS. 12A and 12B, handles 128 are in the unlocked and partially locked positions, respectively. Also with reference to FIG. 11, second portions 70-2 of features 70 receives side portions of each handle 128 when the handle is in the fully locked position in FIG. 12C, allowing door 35 to be closed and retained in such position.

Figure 13A:
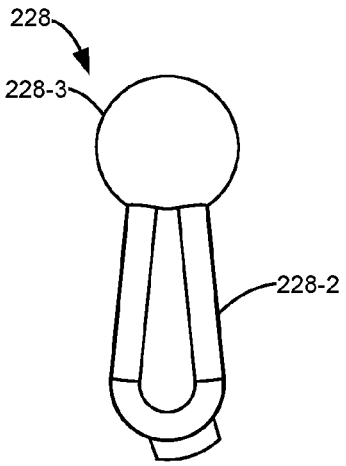
FIGS. 13A, 13B, and 13C are front, back, and side perspective views of a fuser handle, respectively, according to an additional example embodiment.
Figure 13B:
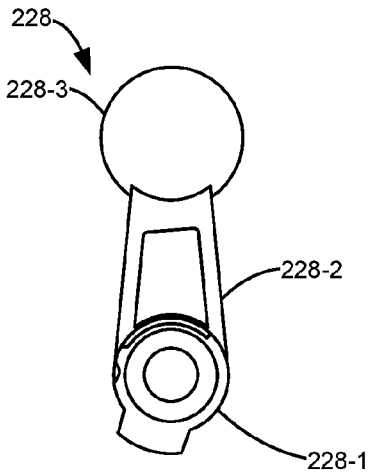
Figure 13C:
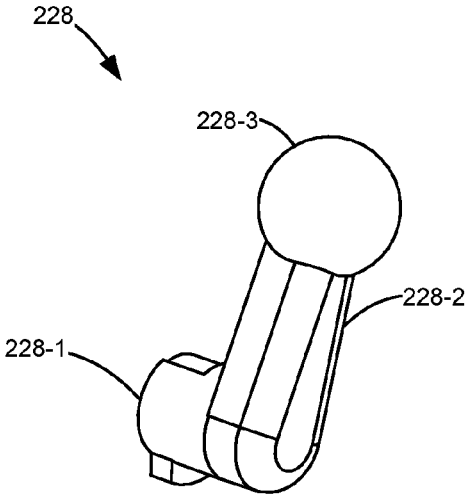
Figure 14A:
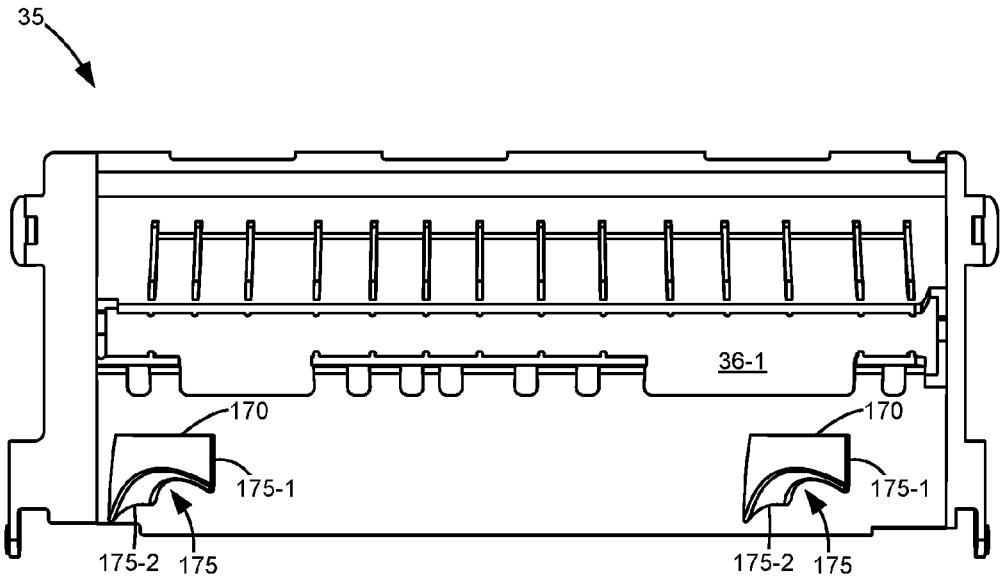
FIGS. 14A and 14B are front and side views, respectively, of an access door including a feature for engaging with the fuser handle in FIGS. 13A-13C, according to an example embodiment.
Figure 14B:
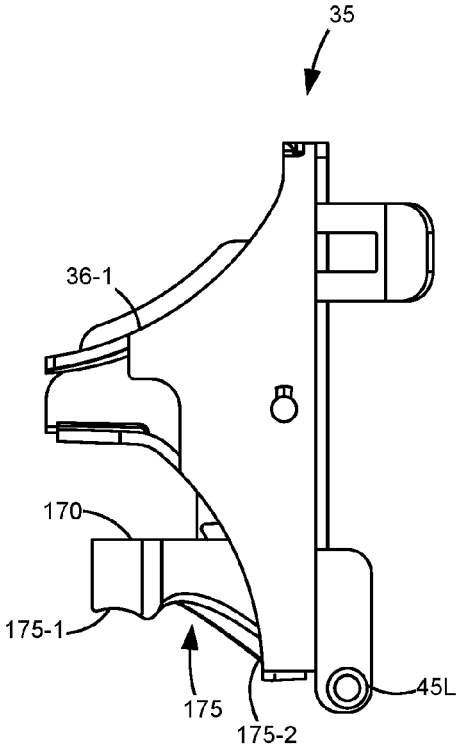

In other example embodiments, door 35 facilitates movement of handles 128 from the unlocked position to the partial or full locked positions and vice-versa, instead of the user manipulating the handles. FIGS. 13A, 13B, and 13C are front, back, and side perspective views, respectively, of another example embodiment of handle 128. FIGS. 14A and 14B are front and side views of door 35 including features for engaging with the handle 228 in FIGS. 13A-13C.

In FIGS. 13A-13C, a handle 228 includes a first portion 228-1 and a second portion 228-2. Similar to handle 128 shown in FIGS. 3A-3H, first portion 228-1 of handle 228 receives second end 122 of a mounting shaft 120, while second portion 228-2 of handle 228 extends from first portion 228-1 of handle 228 and serves to impart rotation to a corresponding mounting shaft 120 when rotated. Second portion 228-1 of handle 228 includes a bulbous end 228-3.

FIGS. 14A and 14B show door 35 including a pair of camming features 170 disposed on inner surface 36-1 of door 35 along a bottom portion thereof. Each feature 170 protrudes from inner surface 36-1 of door 35 and includes a downward-facing arch 175 having a first end portion 175-1 and a second opposing end portion 175-2. Second opposing end portion 175-2 is connected to inner surface 36-1 of door 35 and first end portion 175-1 is a distal end of feature 170.

Figure 15A:
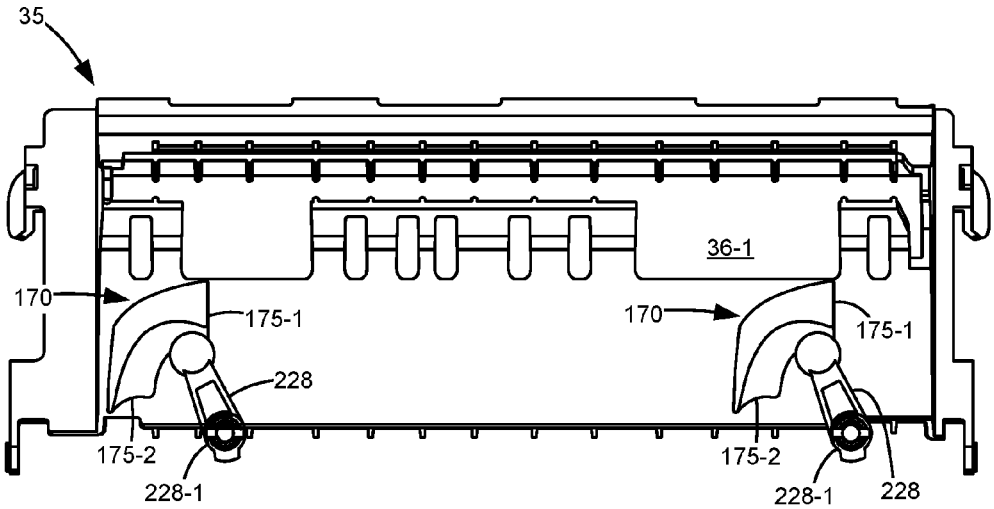
FIGS. 15A-15C are front views of an inner surface of the access door of FIGS. 15A and 15B showing engagement with the fuser handle of FIGS. 14A-14C.
Figure 16A:
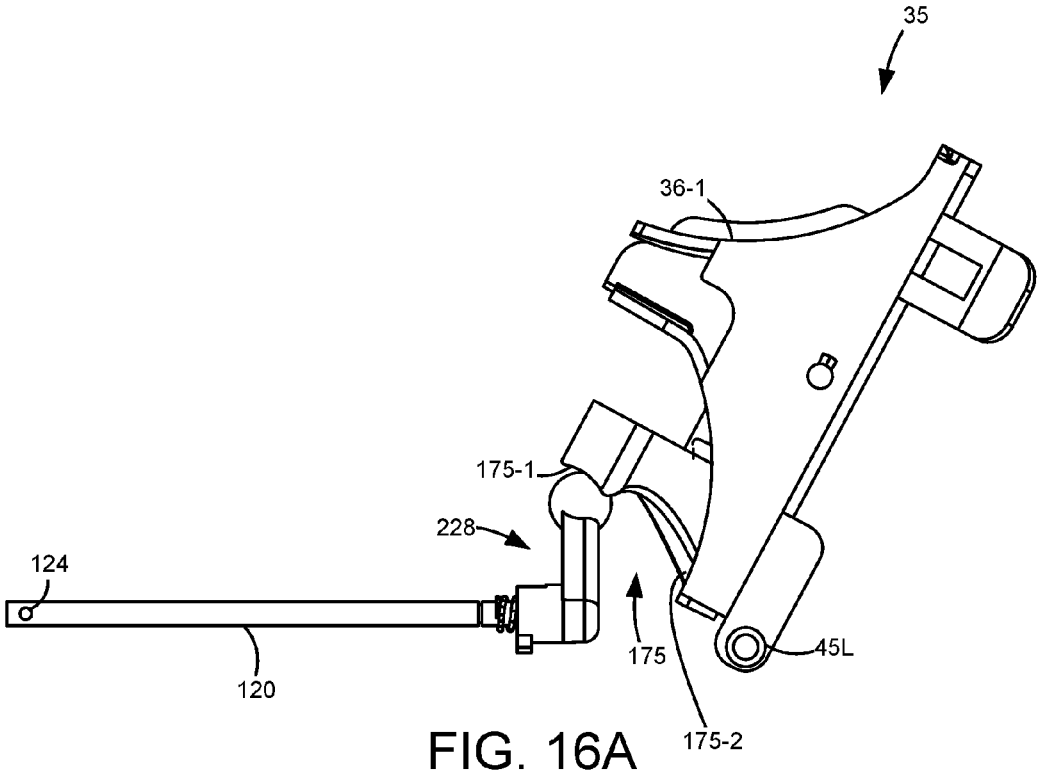
FIGS. 16A-16C are side views of FIGS. 15A-15C, respectively.
Figure 15B:
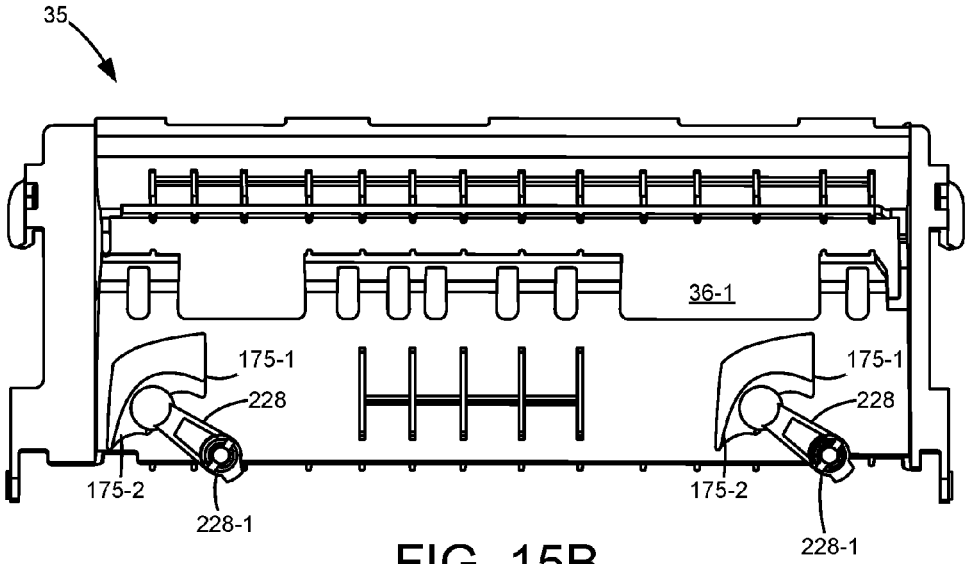
Figure 16B:
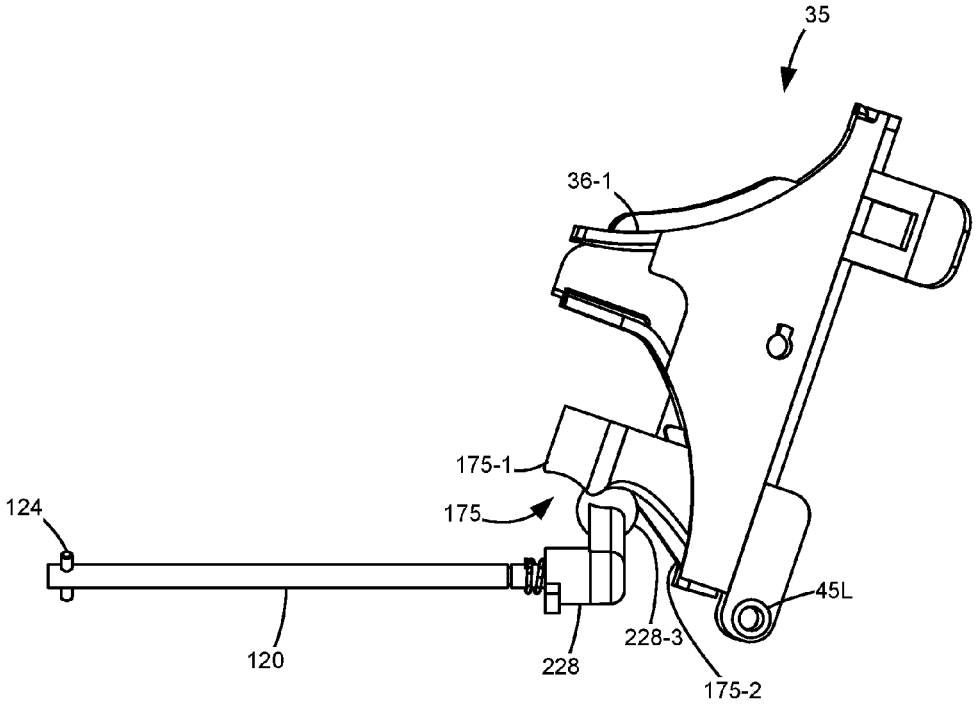
Figure 15C:
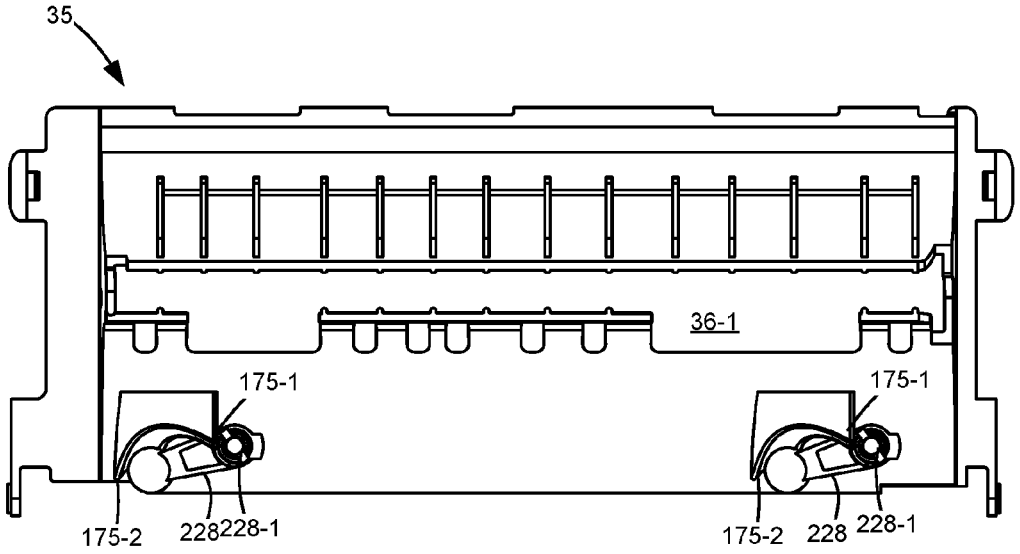
Figure 16C:
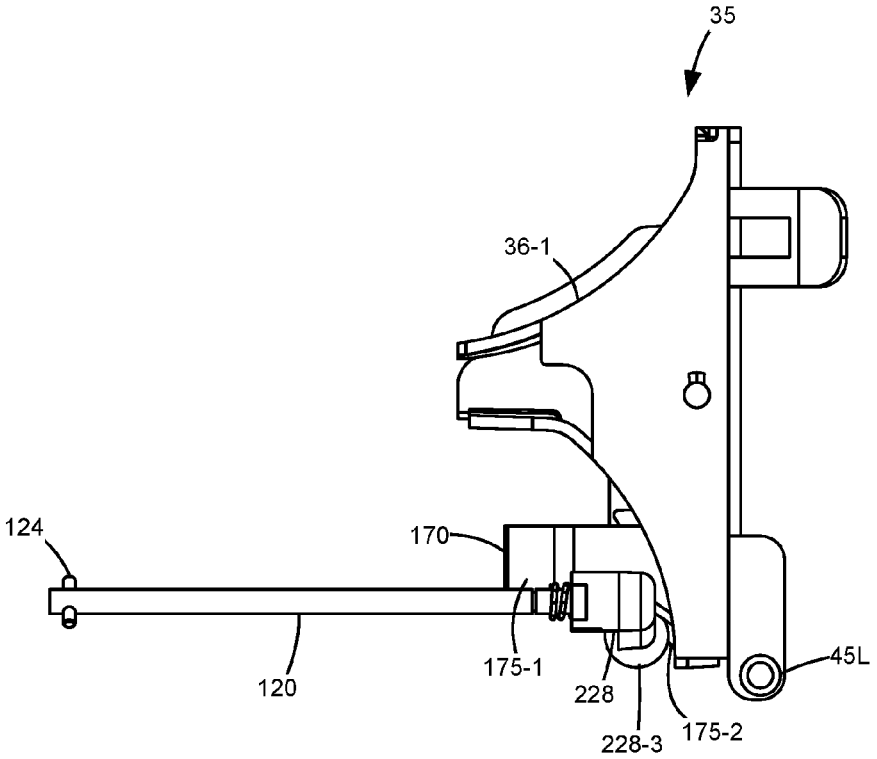

FIGS. 15A-15C and FIGS. 16A-16C show the engagement between handle 228 of FIGS. 13A-13C and feature 170 on door 35 of FIGS. 14A-14C. FIGS. 15A-15C show said engagement from a front view of inner surface 36-1 of door 35, while FIGS. 16A-16C show the orientation of door 35 relative to pivot post 45L (FIG. 1B). In FIG. 15A, handles 228 are in the unlocked position. As door 35 is closed, first end portion 175-1 of each arch 175 on door 35 first contacts bulbous end 228-3 of each handle 228 (FIG. 16A). Following initial contact and as door 35 is further moved towards the closed position (FIG. 16B), handles 228 travel along a central portion of arches 175 such that handles 228 are oriented in the partially locked positions (FIG. 15B). When door 35 is finally closed (FIG. 16C), handles 228 reach corresponding second end portions 175-2 of arches 175 (FIG. 15C). When door 35 is in the closed position, second end portions 175-2 of arches 175 on door 35 receive sides of handles 228. In having arches 175, handles 228 may travel from one of the unlocked or partially locked positions to their fully locked positions as door 35 is being closed. Both handles 228 travel simultaneously along respective arches 175 as door 35 is closed.

Figure 17A:
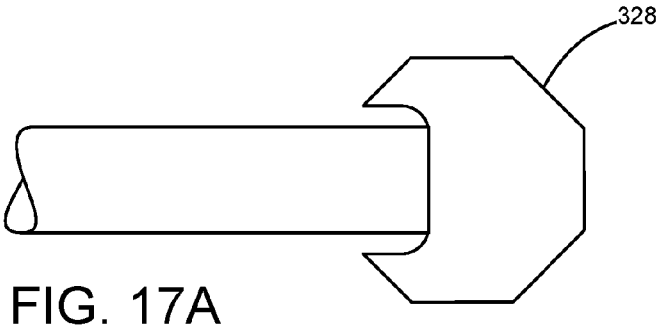
FIG. 17A shows a handle for the fuser assembly in FIGS. 4A and 4B, according to an additional example embodiment.
Figure 17B:
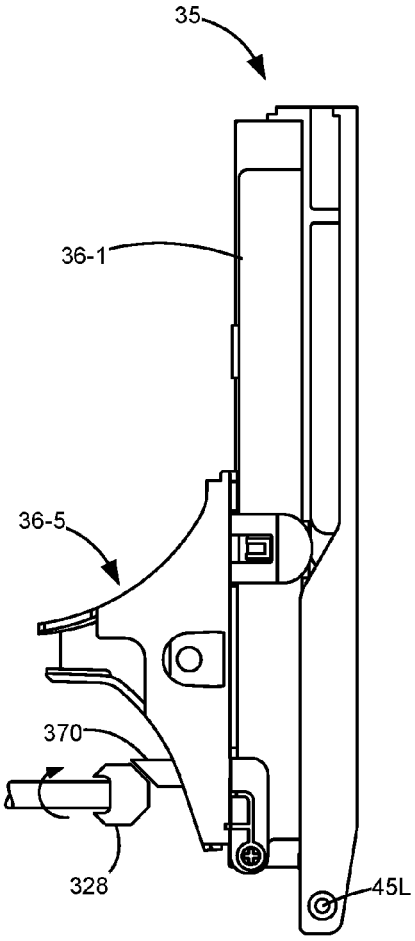
FIG. 17B shows the access door of the imaging device in FIG. 1B including a feature for moving the handle in FIG. 17A as the access door is closed, according to an additional example embodiment.

FIG. 17A shows a handle 328 having a plurality of camming surfaces, according to an additional example embodiment. FIG. 17B shows door 35 of the imaging device 10 of FIG. 1B including at least one locking feature 370 engaging with handle 328 as door 35 is closed. Similar to the embodiments on FIGS. 15A-15C and 16A-16C, as door 35 is moved towards the closed position, locking features 370 contact the camming surfaces of a corresponding handle 328 and drive handles 228 until the fully locked position (FIG. 10A) is reached.

Figure 17C:
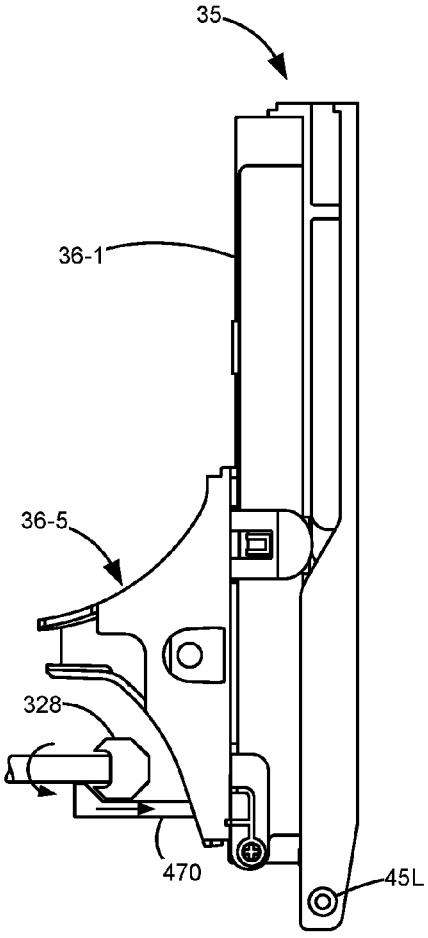
FIG. 17C shows the access door of the imaging device in FIG. 1B including a feature for moving the handle in FIG. 17A as the access door is opened, according to an additional example embodiment.

FIG. 17C shows door 35 of the imaging device 10 of FIG. 1B including at least one unlocking feature 470 engaging with handle 328 of FIG. 17A as door 35 is opened, according to an additional example embodiment. In FIG. 17C, unlocking feature 470 engages with handle 328 on fuser assembly 100 (i.e., handle 128, 228, or 228) as door 35 is opened. Unlocking feature 470 may be sized and shaped to contact a handle when the handle is in either the partially locked or fully locked position and to drive the handle towards the unlocked position. In one aspect, unlocking feature 470 may be hook-like.

In other example embodiments, a mechanism for moving either the unlocking feature on FIG. 17C or the locking feature of FIG. 17B away from handle 328 (FIG. 17A) as the other is being utilized may be included (not shown). In this context, the locking and unlocking feature on the door 35 or portions thereof may include a pivoting member (i.e., a pivot spring) for pivoting either feature away from the handle when one of which is used. For example, as door 35 is closed, locking feature 370 (FIG. 17B) contacts handle 328 for driving the handles in the locked position, while as door 35 is being opened, the same locking feature 370 may be pivoted away from handle 228 such that unlocking feature 470 starts to engage with handle 328.

The description of the details of the example embodiments have been described in the context of a monochrome electrophotographic imaging devices. However, it will be appreciated that the teachings and concepts provided herein are applicable to color electrophotographic imaging devices and multifunction products employing electrophotographic imaging.

The foregoing description of several example embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. An imaging device, comprising:

a frame plate including an opening and a first and a second camming profile at least partly disposed around the opening; and a removable fuser assembly including:

a housing having a front plate and a back plate;

a mounting shaft extending from the front plate to the back plate of the housing having a first end cantilevered from the front plate of the housing and a second end cantilevered from the back plate, the first end of the mounting shaft engaging with the frame plate;

a pin member on the first end of the mounting shaft having a pair of radially extending segments engaging with the first and second camming profiles of the frame plate during installation of the fuser assembly into the imaging device and removal of the fuser assembly from the imaging device; and a handle on the second end of the mounting shaft pivoting the mounting shaft in a first direction and in a second direction opposite the first direction, wherein following insertion of the pin member through the opening of the frame plate during installation of the fuser assembly into the imaging device, pivoting the handle in the first direction causes the pair of segments to travel along the first and second camming profiles in the first direction until the pin member and the handle reach a locked position within the imaging device where the first end of the mounting shaft is prevented from passing through the opening and the fuser assembly is prevented from being removed from the imaging device, and wherein with the pin member and the handle being in the locked position, pivoting the handle in the second direction causes the pair of segments of the pin member to travel along the first and second camming profiles in the second direction until the pin member is aligned with the opening of the frame plate corresponding to the pin member and the handle being in an unlocked position where the first end of the mounting shaft is allowed to pass through the opening of the frame plate for removing the fuser assembly from the imaging device.

2. The imaging device of claim 1, wherein each of the first and second camming profiles includes a top end and a bottom end, wherein an arc length of the first and second camming profiles are equal to each other, and wherein, relative to the opening, the top end and the bottom end of the first camming profile are disposed opposite the bottom end and the top end of the second camming profile, respectively, so that when pivoting the handle in one of the first and the second direction, the pair of segments both travel one of the top end and the bottom end thereof at the same time.

3. The imaging device of claim 2, wherein the frame plate further comprises a first detent and a second detent adjacent the first camming profile and the second camming profile, respectively, each detent being disposed along one of the top end and the bottom end of a corresponding camming profile, wherein when pivoting the handle in the first direction following insertion of the pin member through the opening of the frame plate, the pair of segments of the pin member travel along the first and second camming profiles until the pair of segments are received in the first and second detents, and wherein the pin member and the handle reach the locked position only when the pair of segments of the pin member are received in the first and second detents.

4. The imaging device of claim 3, wherein with the pin member and the handle being in the locked position, pivoting the handle in the second direction causes the pair of segments of the pin member to exit the first and the second detents and travel along the first and second camming profiles until the pin member is aligned with the opening of the frame plate corresponding to the pin member and the handle being in the unlocked position within the imaging device.

5. The imaging device of claim 1, wherein when the pivoting of the handle in the first direction is stopped at a position where the pair of segments are disposed along midway portions of the first and second camming profiles, the pair of segments remain on the midway portions of the first and second camming profiles.

6. The imaging device of claim 1, wherein the handle includes a hollow portion which the second end of the mounting shaft is insertably coupled thereto, wherein the fuser assembly further comprises a biasing member disposed about the second end of the mounting shaft, the biasing member having a first end engaging with the hollow portion of the handle and a second end, wherein the front plate of the housing includes an opening through which the first end of the mounting shaft is received and the second end of the biasing member is abutted, and wherein the biasing member biases the pin member towards the front plate of the housing and maintains engagement between the pin member and the first and second camming profiles following insertion of the pin member through the opening of the frame plate.

7. The imaging device of claim 6, wherein the biasing member is one of a compression spring and a stack of Belleville washers.

8. The imaging device of claim 1, further comprising:

a housing having a pair of opposed side panels and a media path therebetween, the frame plate extending between the pair of opposed side panels; and a door pivotally mounted along an edge thereof to the housing and movable between a raised closed position covering a portion of the media path of the housing and a lowered open position, the door including a feature on an inner surface thereof engaging with the handle when the door is moved in the raised closed position.

9. An imaging device, comprising:

a frame plate including an opening and first and second camming profiles at least partly disposed around the opening; and a removable fuser assembly including:

a housing having a front plate and a back plate;

a mounting shaft extending from the front plate to the back plate of the housing having a first end cantilevered from the front plate and a second end cantilevered from the back plate;

a pin member on the first end of the mounting shaft having a pair of radially extending segments engaging with the first and second camming profiles of the frame plate during installation of the fuser assembly into the imaging device and removal of the fuser assembly from the imaging device;

a handle on the second end of the mounting shaft pivoting the mounting shaft in a first direction and in a second direction opposite the first direction; and a biasing member biasing the pin member towards the front plate of the housing, wherein following insertion of the pin member through the opening of the frame plate during installation of the fuser assembly into the imaging device, pivoting the handle in the first direction causes the pair of segments of the pin member to travel along the first and second camming profiles in the first direction until the pin member and the handle reach a locked position within the imaging device where the first end of the mounting shaft is prevented from passing through the opening such that the fuser assembly is prevented from being removed from the imaging device, and wherein with the pin member and the handle being in the locked position, pivoting the handle in the second direction causes the pair of segments of the pin member to travel along the first and second camming profiles in the second direction until the pin member is aligned with the opening of the frame plate corresponding to the pin member and the handle reaching an unlocked position where the first end of the mounting shaft is allowed to pass through the opening of the frame plate for removing the fuser assembly from the imaging device.

10. The imaging device of claim 9, wherein each of the first and second camming profiles includes a top end and a bottom end, and relative to the opening, the top end and the bottom end of the first camming profile are disposed opposite the bottom end and the top end of the second camming profile, respectively, wherein respective arc lengths of the first and second camming profiles are equal to each other, wherein the frame plate further comprises a first detent adjacent the top end of the first camming profile and a second detent adjacent the top end of the second camming profile, and wherein when pivoting the handle in the first direction following insertion of the pin member through the opening of the frame plate, the pair of segments of the pin member travel upwards the first and second camming profiles towards the first and the second detent.

11. The imaging device of claim 10, wherein following the pivoting of the handle in the first direction from the unlocked position and the first and second detents receiving the pair of segments of the pin member, the pin member and the handle reach the locked position.

12. The imaging device of claim 9, wherein the handle includes a first portion and a second portion used in pivoting the mounting shaft, the first portion being hollow and insertably coupled to the second end of the mounting shaft, wherein the biasing member is a compression spring disposed about the second end of the mounting shaft, the biasing member having a first end engaging with the first portion of the handle and a second end, wherein the front plate of the housing includes an opening through which the first end of the mounting shaft is received and the second end of the biasing member is abutted, and wherein the biasing member biases the pin member towards the front plate of the housing and maintains engagement between the pin member and the first and second camming profiles following insertion of the pin member through the opening of the frame plate.

13. The imaging device of claim 9, further comprising a second frame plate disposed between the frame plate and the front plate of the housing of the fuser assembly, the second frame plate including an opening axially aligned with the opening of the frame plate, and wherein the biasing member biases the pin member towards the front plate of the housing and maintains engagement between the pin member and the first and second camming profiles following insertion of the pin member through the opening of the frame plate.

14. The imaging device of claim 9, wherein at least a portion of the frame plate of the imaging device is resilient so that engagement between the pin member and the first and second camming profiles bends the frame plate towards the front plate of the housing.

15. The imaging device of claim 9, further comprising:

a housing having a pair of opposed side panels and a media path therebetween, the frame plate extending between the pair of opposed side panels; and a door pivotally mounted along an edge thereof to the housing and movable between a raised closed position covering a portion of the media path of the housing and a lowered open position, the door including a feature on an inner surface thereof engaging with the handle when the door is moved in the raised closed position.

16. An imaging device, comprising:

a housing having a pair of opposed side panels and a media path therebetween, the housing including:

a door pivotally mounted along an edge thereof to the housing and movable between a closed position covering a portion of the media path between the pair of opposed side panels and an open position, the door including a pair of camming members on an inner surface thereof;

a frame plate extending between the pair of opposed side panels and aligned with the door when the door is in the closed position, the frame plate including:

a pair of openings on opposite ends thereof; and a first pair and a second pair of camming surfaces at least partly disposed around a respective opening of the pair of openings; and a removable fuser assembly mounted onto the frame plate, including:

a front plate and a back plate;

a pair of mounting shafts extending through the front and back plates of the removable fuser assembly, each mounting shaft having a first end cantilevered from the front plate and a second end cantilevered from the back plate;

a pair of pin members on the first ends of the pair of mounting shafts, a first pin member and a second pin member of the pair of pin members respectively engaging with the first pair of camming surfaces and the second pair of camming surfaces of the frame plate during installation of the fuser assembly into the imaging device and removal of the fuser assembly from the imaging device, the pair of pin members each comprising a pair of radially extending segments equally disposed about the first end of one of the pair of mounting shafts; and a pair of handles on the second ends of the pair of mounting shafts, a first and a second handle of the pair of handles respectively engaging with a first and a second camming member of the pair of camming members of the door when the door is moved between the closed and the open position, the pair of handles rotatably coupled with the pair of mounting shafts and pivotable between a first direction and in a second direction opposite the first direction, wherein the pair of camming members of the door protrude from the inner surface thereof such that, following insertion of the pair of pin members of the fuser assembly through the pair of openings on the frame plate, when the door is moved in the closed position, the pair of camming members of the door engage with the pair of handles of the fuser assembly.

17. The imaging device of claim 16, wherein when the door is in the closed position, each of the pair of camming members thereof engage with a first portion of a corresponding one of the pair of handles, and wherein, following initial insertion of the pair of pin members of the fuser assembly through the pair of openings on the frame plate, when the door is moved to the closed position, contact between the pair of camming members of the door and a second portion of one of the pair of handles different from the first portion prevents the door from being moved to the closed position.

18. The imaging device of claim 17, wherein following the pair of pin members and the pair of handles being locked with the frame plate, moving the door towards the open position causes the pair of camming members of the door to contact the pair of handles of the fuser assembly, contact with the door as the door moves toward the open position thereof causes the pair of handles to pivot in the second direction thereof, pivoting of the pair of handles in the second direction causes the pair of mounting shafts to rotate in the same direction thereof, and rotation of each of the pair of mounting shafts in the second direction causes the pair of segments on respective first ends thereof to travel along the first pair and the second pair of camming surfaces such that the pair of pin members are aligned with the pair of openings on the frame plate and the pair of pin members and the pair of handles are unlocked from the frame plate, allowing the first ends of the pair of mounting shafts to pass through the pair of openings of the frame plate and the fuser assembly to be removed from the imaging device.

19. The imaging device of claim 16, wherein when moving the door between the closed position and the open position, the pair of camming members contacts the pair of handles and drives the pair of handles to pivot towards the first direction and the second direction, respectively.

20. The imaging device of claim 16, wherein following insertion of the pair of pin members of the fuser assembly through the pair of openings on the frame plate, moving the door towards the closed position causes the pair of camming members of the door to contact the pair of handles of the fuser assembly, contact with the pair of camming members of the door as the door moves toward the closed position causes the pair of handles to pivot in the first direction thereof, pivoting the pair of handles in the first direction causes the pair of mounting shafts to rotate in the same direction thereof, and rotation of each of the pair of mounting shafts in the first direction causes the pair of segments on respective first ends thereof to travel along the first pair and the second pair of camming surfaces such that the pair of pin members and the pair of handles are locked with the frame plate and the fuser assembly is prevented from being removed from the imaging device when the door is in the closed position.

* * * * *